US012534330B2

(12) United States Patent
Dini et al.

(10) Patent No.: US 12,534,330 B2
(45) Date of Patent: Jan. 27, 2026

(54) FOLDING OR INTERFOLDING UNIT, AND METHOD FOR FOLDING OR INTERFOLDING A PLURALITY OF SHEETS OF PAPER

(71) Applicant: KÖRBER TISSUE FOLD S.R.L., Porcari (IT)

(72) Inventors: Graziano Dini, Bagni di Lucca (IT); Daniele Dettori, Capannori (IT); Massimo Bianchi, Viareggio (IT)

(73) Assignee: KÖRBER TISSUE FOLD S.R.L., Porcari (IT)

( * ) Notice: Subject to any disclaimer, the term of this patent is extended or adjusted under 35 U.S.C. 154(b) by 176 days.

(21) Appl. No.: 18/287,872

(22) PCT Filed: May 4, 2022

(86) PCT No.: PCT/IB2022/054122
§ 371 (c)(1),
(2) Date: Oct. 20, 2023

(87) PCT Pub. No.: WO2022/234481
PCT Pub. Date: Nov. 10, 2022

(65) Prior Publication Data

US 2024/0208767 A1 Jun. 27, 2024

(30) Foreign Application Priority Data

May 6, 2021 (IT) ..... 102021000011531

(51) Int. Cl.
*B65H 45/24* (2006.01)
*B65H 45/16* (2006.01)

(52) U.S. Cl.
CPC ..... *B65H 45/24* (2013.01); *B65H 45/165* (2013.01); *B65H 45/168* (2013.01);
(Continued)

(58) Field of Classification Search
CPC ..... B31F 1/10; B65H 45/16; B65H 45/24; B65H 45/168; B65H 45/20; B65H 45/101;
(Continued)

(56) References Cited

U.S. PATENT DOCUMENTS 4,332,582 A * 6/1982 Hertrich ..... B65H 45/168 493/432
4,381,106 A * 4/1983 Loebach ..... B41F 13/64 270/47
(Continued)

FOREIGN PATENT DOCUMENTS

CN 108285060 A * 7/2018
DE 20023105 U1 * 3/2003 ..... B65H 31/04
(Continued)

OTHER PUBLICATIONS

Espacenet machine translation of DE20023105U1; https://translationportal.epo.org/emtp/translate/?ACTION=description-retrieval&COUNTRY=DE&ENGINE=google&FORMAT=docdb&KIND=U1&LOCALE=en_EP&NUMBER=20023105&OPS=ops.epo.org/3.2&SRCLANG=de&TRGLANG=en (Year: 2003).*

*Primary Examiner* — Leslie A Nicholson, III
(74) *Attorney, Agent, or Firm* — Maschoff Brennan

(57) ABSTRACT

A folding or interfolding unit of a plurality of sheets of paper comprising a first and a second folding or interfolding roll to fold, or interfold, the plurality of sheets of paper according to a predetermined folding or interfolding configuration, at a folding or interfolding zone. Each folding or interfolding roll comprises a tubular body which rotates about a longitudinal rotation axis oriented along a horizontal direction and a plurality of gripping groups integral in rotation with the tubular body. Each gripping group comprises a mechanical gripping member configured to move, at a gripping point, from a releasing configuration to a gripping configu-
(Continued)

ration, where is arranged to mechanically hold the, or each, sheet up to a releasing point having a second angular position.

14 Claims, 17 Drawing Sheets

(52) U.S. Cl.
CPC .... *B65H 2403/45* (2013.01); *B65H 2403/512* (2013.01); *B65H 2406/351* (2013.01); *B65H 2511/11* (2013.01); *B65H 2513/10* (2013.01); *B65H 2515/10* (2013.01)

(58) Field of Classification Search
CPC ..... B65H 45/165; B65H 2406/351; B65H 2403/45; B65H 2403/512
USPC ..... 270/39.01, 39.05, 39.06
See application file for complete search history.

(56) References Cited

U.S. PATENT DOCUMENTS

| | | | | |
|---|---|---|---|---|
| 7,121,994 | B2 * | 10/2006 | Haasl | B65H 45/24 493/405 |
| 8,123,665 | B2 * | 2/2012 | De Matteis | B65H 29/6618 493/413 |
| 11,208,292 | B2 * | 12/2021 | Mazzaccherini | B65H 45/163 |
| 2007/0135286 | A1 | 6/2007 | St. Ours et al. | |

FOREIGN PATENT DOCUMENTS

| | | | |
|---|---|---|---|
| EP | 1 457 444 | A2 | 9/2004 |
| EP | 1 520 819 | A1 | 4/2005 |
| WO | 2004/071921 | A1 | 8/2004 |
| WO | 2019/207434 | A1 | 10/2019 |

* cited by examiner

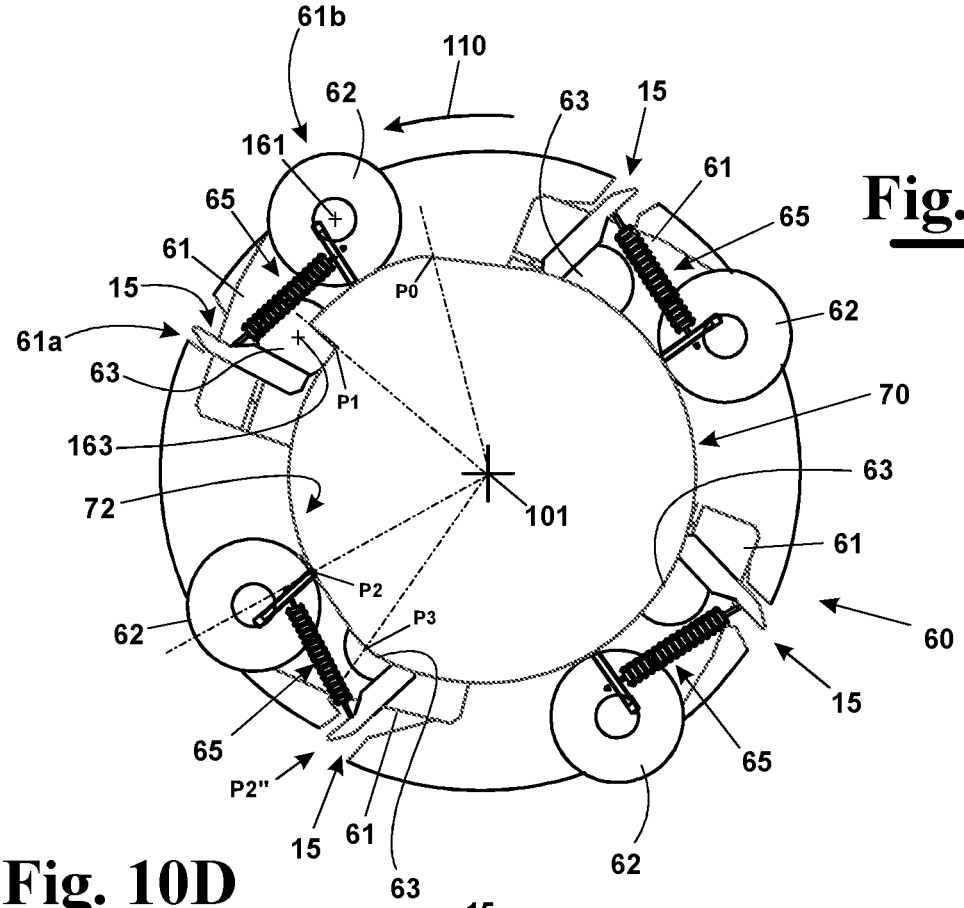
Fig. 10C
Fig. 10D
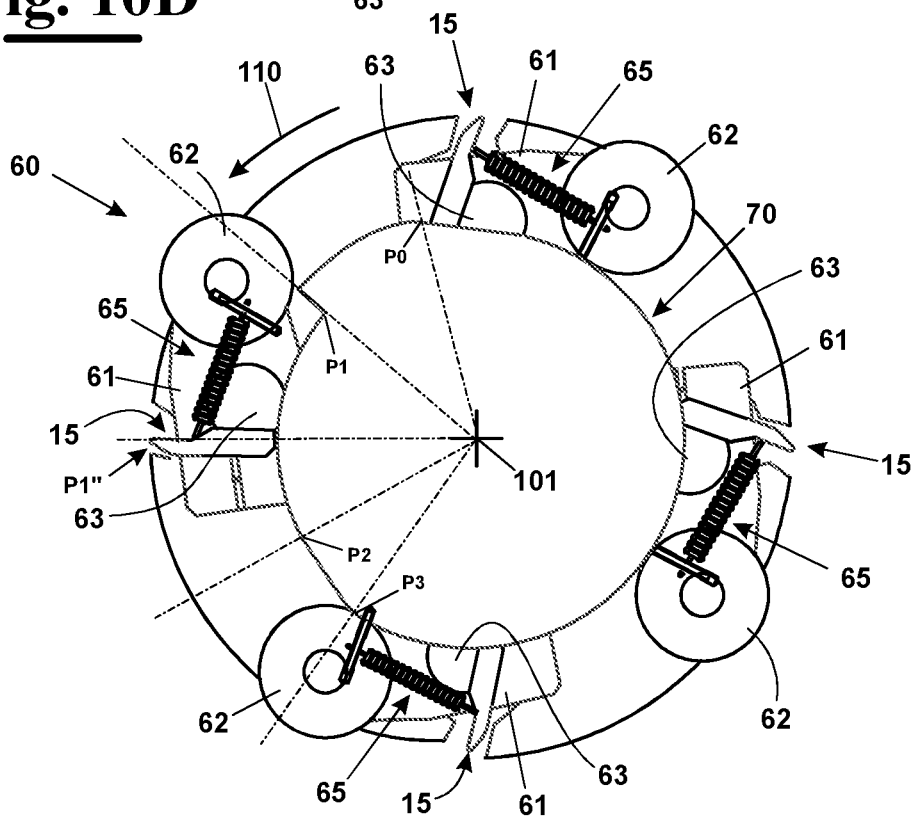

Fig. 13A
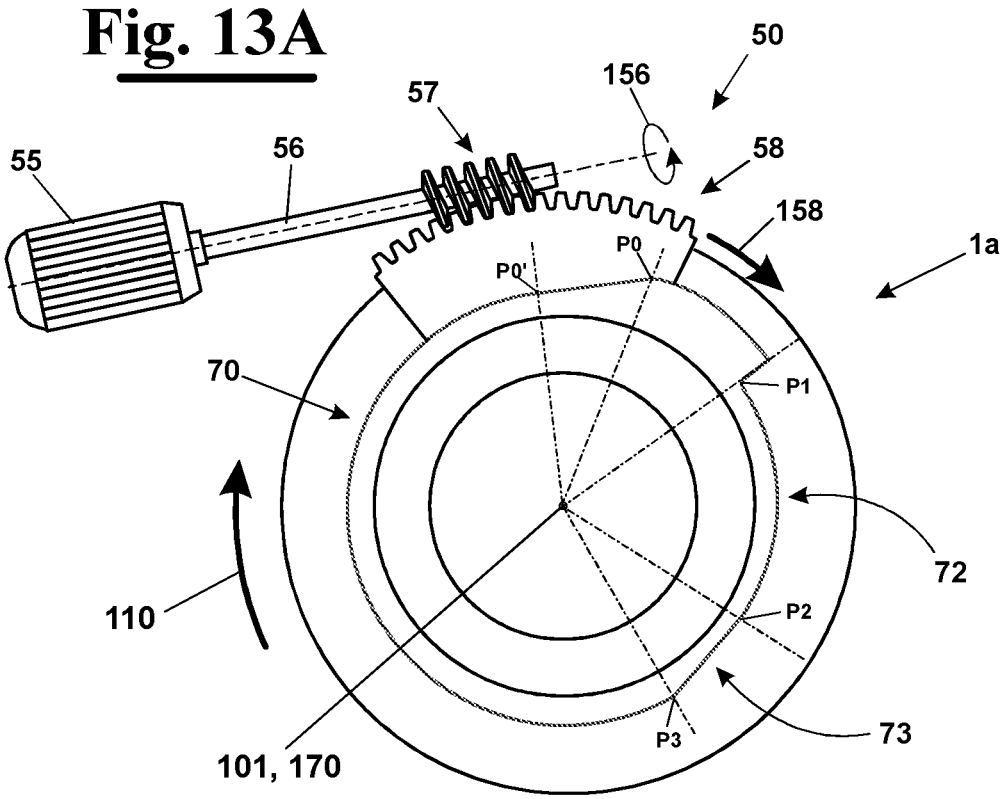
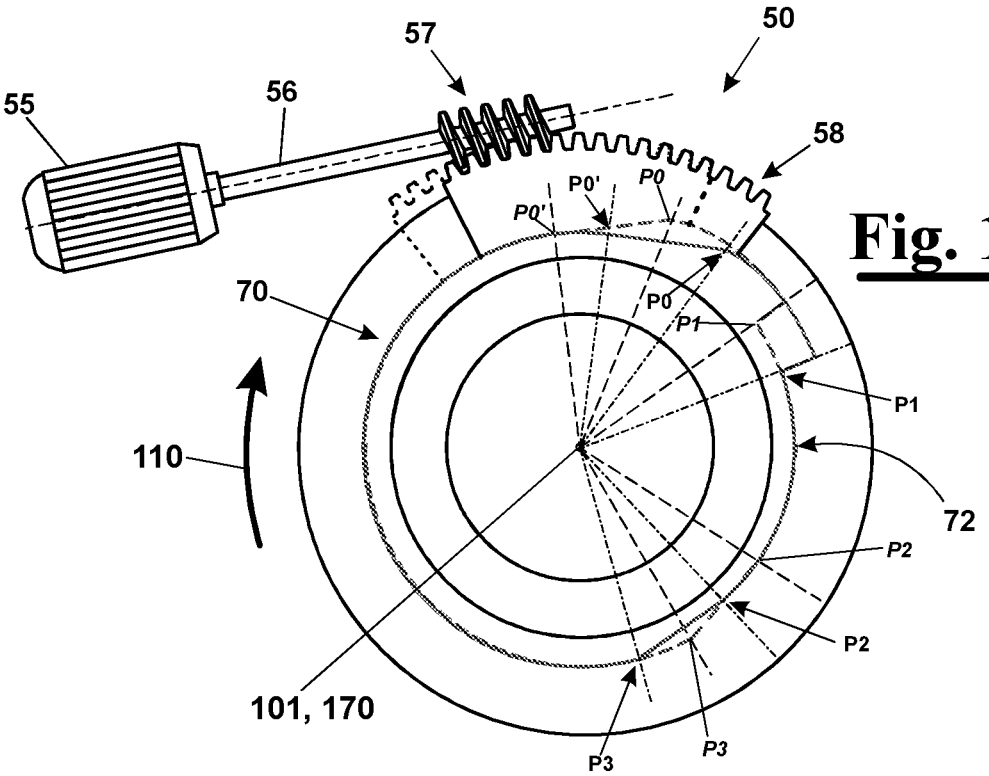
Fig. 13B

FOLDING OR INTERFOLDING UNIT, AND METHOD FOR FOLDING OR INTERFOLDING A PLURALITY OF SHEETS OF PAPER

FIELD OF THE INVENTION

The present invention relates to the paper converting field and similar products, and in particular it relates to a unit for folding or interfolding sheets of paper in a machine for folding or interfolding sheets of paper.

DESCRIPTION OF THE PRIOR ART

As known, folding and interfolding machines exist equipped with systems for causing the worked sheets of paper to adhere on the surface of rolls, in order to guide them along a predetermined trajectory to carry out the fold according to a determined folding or interfolding configuration.

The systems that carry out the aforementioned adhesion provide mechanical pliers, or alternatively, pneumatic suction systems.

The systems of mechanical type normally provide pliers distributed along the circumference of the folding roll and arranged to selectively and alternatively move between a gripping configuration and a releasing configuration of the worked web or sheet. The succession of the gripping and releasing steps of the sheets by the two folding or interfolding rolls, allows to carry out a determined number of folds on the worked web, or sheets.

Patent No. EP1520819 describes, for example, an interfolding machine where the folding rolls are equipped with pliers and wedges in such a way that a wedge of a folding roll is able to introduce the sheets into a respective pliers of the other folding roll. The wedges have to be moved according to two degrees of freedom, in order to have a swinging and a radial motion, in order to be able to fit with the pliers arranged on the other roll with which they cooperate.

However, the mechanical systems are not able to work at high speed because the devices of a roll causing the introduction of the web or sheet of paper into the pliers of the other roll as well as the actuation devices of mechanical type, and that cause the pliers to move from the gripping configuration to the releasing configuration and vice versa, are not able to work synchronously with each other at high speed. Furthermore, these devices are very complicated, expensive and need to be often subjected to maintenance interventions due to the wear of the wedges and their breaking that frequently occur.

In the case of pneumatic suction systems a device is provided for generating a predetermined vacuum degree, normally a vacuum pump, pneumatically connected to the inner part of the suction roll. More precisely, the surface of the suction roll is provided with a determined number of rows of suction holes distributed on the roll surface in such a way to cause the worked web, or sheet, of paper to adhere only at determined portions of the same. Normally, a suction roll is provided with 3, or 4, close couples of rows of suction holes positioned at 120°, or 90°, with respect to each other, and pneumatically connected to the device for generating a predetermined vacuum degree at determined angular positions of the suction roll, in such a way to cause the worked web or sheet of paper to adhere at a determined sector of the surface of the suction roll.

A known type of suction rolls is, for example, described in EP1457444. In particular, the folding roll comprises a tubular body provided with the aforementioned plurality of rows of holes, for example 4 couples of rows of holes positioned at 90° with respect to each other and configured to rotate during working conditions about a longitudinal axis. The suction roll is, furthermore, provided with a second tubular body mounted within the aforementioned tubular body and coaxially to it. In particular, the inner tubular body is pneumatically connected to a device for generating a determined vacuum degree, and two sealing members are, furthermore, provided that extend longitudinally between the aforementioned tubular bodies at opposite sides of the, or each, aperture. In this way, the inner tubular body, the internal surface of the external tubular body and the two longitudinal sealing members, define together a suction chamber at a determined position of the suction roll.

Therefore, the web or sheet of paper is sucked by the suction chamber at a first point P1 having a first predetermined angular position, at which a longitudinal row of suction holes is positioned by the rotation of the external tubular body at the aforementioned suction chamber, or, more precisely, immediately downstream of the first sealing member. The web or sheet of paper is instead, then, released at a second point P2, having a second predetermined angular position, at which the aforementioned longitudinal row of suction holes is positioned by the rotation of the external tubular body at a position external to the aforementioned suction chamber, or, more precisely, immediately downstream of the second sealing member. Therefore, the web or sheet of paper is retained on the portion of the surface of the suction roll comprised between the first and the second point P1 and P2 to carry out the aforementioned cutting or folding operation, or the movement along the machine.

However, the solution described in EP1457444, as well as other analogous prior art solutions, has some drawbacks.

In particular, the speed at which the web or sheet of paper is folded, or interfolded, by the folding unit, cannot exceed a predetermined advancing speed threshold value, normally about 150-200 m/min, value that is established by the constructional and functioning limitations of determined components of the machine.

In fact, if the aforementioned speed values are not met, during the functioning of the machine, drawbacks of different nature can occur. In particular, if the aforementioned threshold values are exceeded, due to the inertia of the paper, the worked web or sheet, remains adhered to the surface of the suction roll also after the second angular position, that means to a portion of the surface that is positioned downstream of the second sealing member. This causes a fold of the web or sheet of paper that is not accurate and besides unavoidably compromising the quality of the final product, in particular forming unwanted folds, can also causes jamming of the paper that obliges to stop the machine to remove the jammed paper with consequent loss of time and productivity.

Therefore, in order to avoid the aforementioned working and quality problems of the final product it is necessary to operate at predetermined speeds beyond which it is not possible to work.

Analogous drawbacks have been found in the prior art machines also when a web, or sheet of paper having a paper weight different from a predefined paper weight on the basis of which the aforementioned suction roll has been designed. In fact, due to the higher inertia that a higher paper weight shows with respect to a paper with a lower paper weight, if a web or sheet of paper with a paper weight greater than a predetermined paper weight, the worked web, or sheet of paper remains adhered to the suction roll surface beyond the predefined releasing point, and, in general, tends to cover more space once that the suction of the roll ends, thus causing the aforementioned functional and product quality problems. Therefore, the prior art machines having suction rolls are rigid because they have to accept quality compromises to be able to work webs or sheets of paper with different paper weights.

Other examples of folding rolls with analogous drawbacks are also described in WO2019/207434, US2007135286 and WO2004/071921.

SUMMARY OF THE INVENTION

It is, therefore, an object of the present invention to provide a folding or interfolding unit which is able to overcome the aforementioned drawbacks of the folding or interfolding units of prior art.

It is, in particular, an object of the present invention to provide a folding or interfolding unit that is structurally easier than the prior art units, able to produce a final product of excellent quality even at high advancing speeds of the web or sheet of paper along the machine, in particular higher than 300 m/min.

These and other objects are achieved by a folding or interfolding unit of a plurality of sheets of paper, comprising:

- a first and a second folding or interfolding roll configured to fold or interfold said plurality of sheets of paper according to a predetermined folding or interfolding configuration at a folding or interfolding zone, each said first and second folding or interfolding rolls comprising:
  - a tubular body configured to rotate in a predetermined direction of rotation about a longitudinal rotation axis oriented along a horizontal direction;
  - a plurality of gripping groups in integral rotation with said tubular body, each gripping group of said plurality comprising:
    - a mechanical gripping member configured to move, at a gripping point (P1") having a first predetermined angular position, from a releasing configuration to a gripping configuration, in which is arranged to mechanically hold said or each sheet of said plurality of sheets up to a releasing point (P2") having a second predetermined angular position;
    - at least one suction hole associated to each mechanical gripping member and configured to cause said or each sheet of paper to be sucked to introduce the same into said mechanical gripping member;
  - a vacuum distribution device configured to selectively pneumatically connect at least one suction hole at a time to a device for generating a determined vacuum degree in such a way to cause said or each, sheet to be sucked between a position of starting suction (P1') and a position of ending suction (P2');
- whose main characteristic is that each said first and second folding or interfolding rolls, furthermore, comprises:
  - an actuation group configured to cause a mechanical gripping member at a time of said plurality to move from said releasing configuration to said gripping configuration at said gripping point and from said gripping configuration to said releasing configuration at said releasing point;
  - an adjustment group configured to move said actuation group with respect to said respective folding, or interfolding roll to selectively position the same in a predetermined spatial position to which correspond a first and a second predetermined angular position of said gripping point and of said releasing point (P1", P2") respectively.

Other technical characteristics of the present invention and the related embodiments are set out in the dependent claims.

In particular, each actuation group can provide a guide member configured to guide each mechanical gripping member at a time along a predetermined trajectory during rotation of the folding or interfolding roll about the longitudinal axis. More in particular, the guide member can comprise at least one closing stretch arranged to cause each mechanical gripping member to move from the releasing configuration to the gripping configuration, and at least one opening stretch arranged to cause each mechanical gripping member to move from the gripping configuration to the releasing configuration.

Advantageously, each adjustment group can be configured to rotate the guide member with respect to the folding, or interfolding roll about the respective respective longitudinal axis to position the guide member in the predetermined spatial position.

In an embodiment of the invention, each guide member can comprise a first portion provided with the closing stretch, and at least a second portion provided with the opening stretch, and wherein at least one between the first and the second portion of the guide member can be configured to move with respect to the respective folding, or interfolding roll to position in a predetermined spatial position.

In particular, the adjustment group can comprise a first displacement device configured to rotate the first portion of the guide member with respect to the respective folding, or interfolding roll to position the same in a first predetermined spatial position, and a second displacement device configured to rotate the second portion of the guide member with respect to the respective folding, or interfolding roll to position the same in a second predetermined spatial position, in such a way to adjust the position of the gripping point and of the releasing point independently from each other.

Preferably, each folding or interfolding roll, furthermore comprises a fixed tubular body positioned coaxially to the aforementioned tubular body, the fixed tubular body being provided with an external lateral surface and with an internal lateral surface communicating with each other by at least one aperture and having a longitudinal cavity pneumatically communicating to the aforementioned device for generating a determined vacuum degree.

In particular, the aforementioned vacuum distribution device comprises a suction chamber pneumatically communicating to the aforementioned longitudinal cavity and delimited by an internal lateral surface of the aforementioned tubular body and laterally by a first and a second sealing element which extends longitudinally to the aforementioned tubular body. More in particular, the aforementioned suction chamber is configured to selectively pneumatically connect the aforementioned longitudinal cavity to a suction hole at a time between the first and second predetermined angular positions (P1, P2).

According to another aspect of the invention, a method for folding or interfolding a plurality of sheets of paper, comprises the steps of:

folding or interfolding by a first and a second folding or interfolding roll said plurality of sheets of paper according to a predetermined folding or interfolding configuration at a folding or interfolding zone, each said first and second folding or interfolding rolls comprising:

a tubular body configured to rotate in a predetermined direction of rotation about a longitudinal rotation axis oriented along a horizontal direction;

a plurality of gripping groups integral in rotation with said tubular body, each gripping group of said plurality comprising:

a mechanical gripping member configured to move, at a gripping point (P1") having a first angular position, from a releasing configuration to a gripping configuration, where is arranged to mechanically hold said or each, sheet of said plurality of sheets up to a releasing point having a second angular position (P2");

at least one suction hole associated to each mechanical gripping member and configured to cause said or each sheet of paper to be sucked to introduce the same into said mechanical gripping member;

a vacuum distribution device configured to selectively pneumatically connect at least one suction hole at a time to a device for generating a determined vacuum degree in such a way to cause said or each sheet to be sucked between a position of starting suction (P1') and a position of ending suction (P2');

whose main characteristic is that it furthermore provided the steps of:

causing by an actuation group a mechanical gripping member at a time of said plurality to move from said releasing configuration to said gripping configuration at said gripping point (P1") and from said gripping configuration to said releasing configuration at said releasing point (P2");

moving by an adjustment group said actuation group with respect to said respective folding, or interfolding roll, to selectively position the same in a predetermined spatial position to which correspond a first and a second angular position of said gripping point and of said releasing point (P1", P2") respectively.

BRIEF DESCRIPTION OF THE DRAWINGS

The invention will now be shown with the following description of its exemplary embodiments, exemplifying but not limitative, with reference to the attached drawings in which:

FIG. 2 diagrammatically shows a transverse section view of a possible embodiment of a folding or interfolding roll of which the folding or interfolding unit of FIG. 1 can be equipped with;

FIG. 8 diagrammatically shows a transverse section view of another possible embodiment of a folding or interfolding roll, of which the folding or interfolding unit according to the invention can be equipped with;

FIGS. 10A to 10D diagrammatically show a possible operative sequence carried out by an embodiment foreseen by the invention of an actuation group of a folding, or suction roll;

FIGS. 13A to 14B diagrammatically show another alternative embodiment of a folding or interfolding roll according to the invention in different working configurations;

DETAILED DESCRIPTION OF SOME EXEMPLARY EMBODIMENTS OF THE INVENTION

Figure 1:
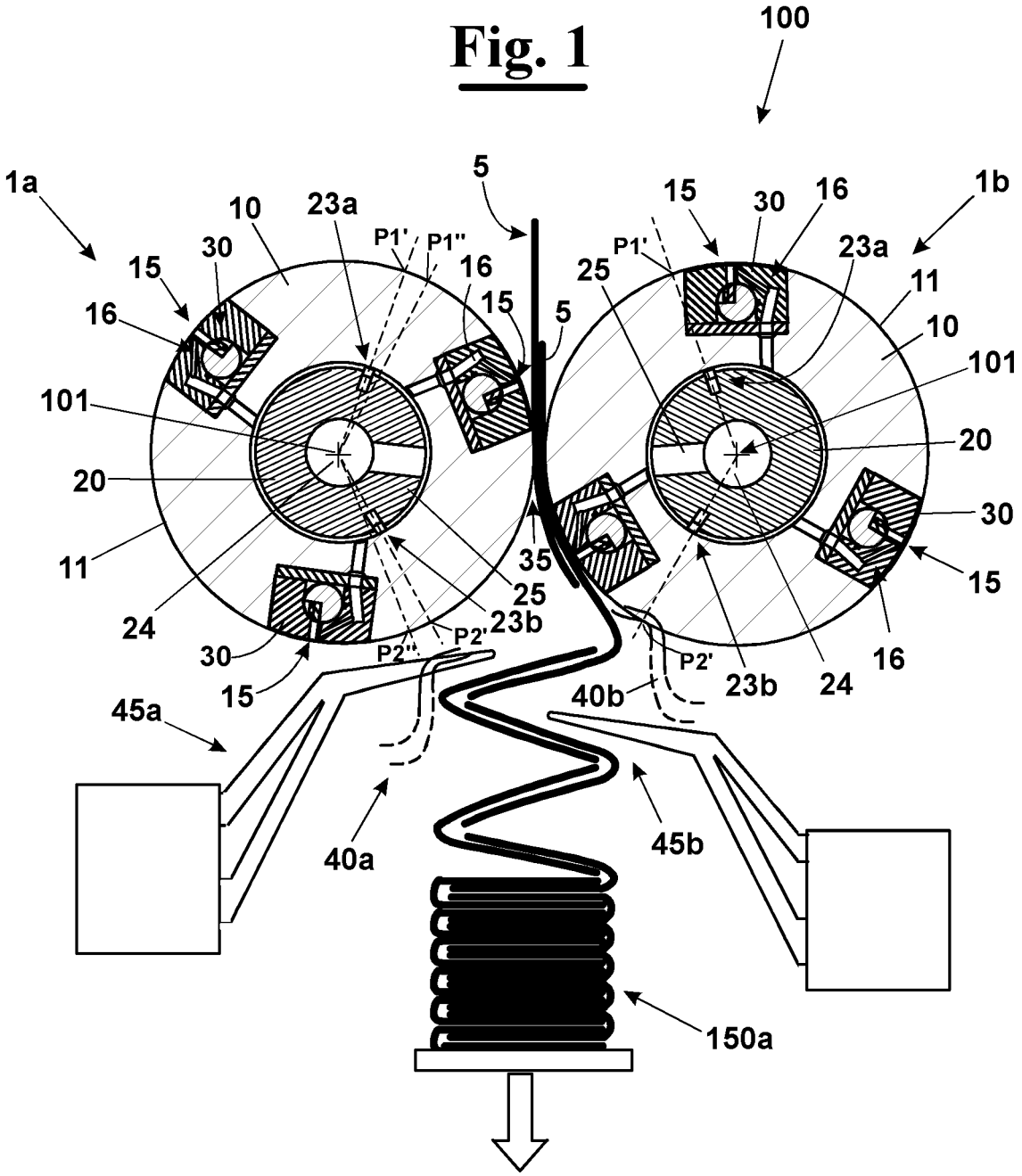
FIG. 1 diagrammatically shows a side elevation partly sectioned view of a first embodiment of a folding or interfolding unit according to the invention.

As diagrammatically shown in FIG. 1, a first embodiment of a folding or interfolding unit 100, according to the invention, of a plurality of sheets of comprises a first and a second folding or paper 5, interfolding roll 1*a*, and 1*b* configured to fold or interfold the aforementioned plurality of sheets of paper 5 according to a predetermined folding or interfolding configuration, at a folding or interfolding zone 35. In particular, each the first and second folding or interfolding rolls 1*a* and 1*b* comprises a tubular body 10 provided with external an lateral surface 11 and configured to rotate in a predetermined direction of rotation 110 about a longitudinal rotation axis 101, in particular oriented along a horizontal direction, or substantially horizontal. Each folding or interfolding roll 1*a*, or 1*b* is, furthermore, provided with a plurality of mechanical gripping groups 30, each of which comprising a mechanical gripping member 15, in the following also called "pliers member". More precisely, each gripping member 15 is configured to move, at a gripping point P1" having a first predetermined angular position, from a releasing configuration to a gripping configuration, where is arranged to mechanically hold the, or each, sheet 5 up to a releasing point P2" having a second predetermined angular position where is arranged to release the sheet 5.

Still as diagrammatically shown in FIG. 1 the folding or interfolding unit 100 can provide, furthermore, a first and a second plurality of removing fingers 40*a* and 40*b* configured to cause the aforementioned plurality of sheets of paper 5 to be removed from the external surface 11 of a respective folding, or interfolding roll 1*a* and 1*b*. In particular, the first and second pluralities of removing fingers 40*a* and 40*b* are, advantageously, are moved in phase with the folding or interfolding rolls 1*a* and 1*b*, in such a way that t can, alternatively, laterally and/or vertically move towards the, or each, worked sheet 5, and move the same away from the respective roll 1*a*, or 1*b*, to cause, this way, the same to be removed from the surface of the roll to which it adheres.

In particular, still as diagrammatically shown in FIG. 1, the folding or interfolding machine equipped with the folding or interfolding unit 100, according to the invention, provides, furthermore, a separation group comprising a first and a second plurality of separation members 45*a* and 45*b*, configured to enter from opposite sides into a completed stack of folded or interfolded sheets 150*a*, and to divide the same from a following stack of folded or interfolded sheets, not shown in the figure for simplicity. More in particular, a displacement unit, not shown in the figure for simplicity, is provided configured to move the separation members 45*a* and 45*b* between a first and a second position along a predetermined back and forth motion trajectory with respect to the folding or interfolding rolls 1*a* and 1*b*.

According to the present invention, each gripping group 30, furthermore, comprises, at least one suction hole 16. In particular, the, or each, suction hole 16 is arranged to cause the or each sheet of paper 5 to be sucked in order to be introduced into the gripping member 15. More in particular, the, or each, suction hole 16 is pneumatically connected to a device for generating a predetermined vacuum degree, not shown in the figure for simplicity, by a vacuum distribution device. This latter is configured to selectively pneumatically connect a suction hole 16 of the folding or interfolding roll, 1*a*, or 1*b*, to the aforementioned device for generating a determined vacuum degree and to cause the, or each, sheet to be sucked between a position of starting suction P1' and a position of ending suction P2'. In particular, the, or each, suction hole 16 can be pneumatically connected to the aforementioned device for generating a determined vacuum degree between a point of starting suction P1', preferably positioned upstream of the gripping point, and a point of ending suction P2' positioned upstream, or downstream, of the releasing point.

The particular technical solution according to the present invention allows, with respect to the prior art solutions, to work the sheets 5 in order to fold, or interfold them at a speed of, or even higher than 300 m/min, in particular because the mechanical gripping members 15 associated to the aforementioned suction holes 16 are able to catch and release the, or each, worked sheet 5 at extremely accurate angular positions besides exerting a higher gripping strength on the, or each, sheet 5. Furthermore, the present solution allows to avoid the use of wedges, or other mechanical introduction members, to introduce the paper into the gripping members 15.

Figure 2:
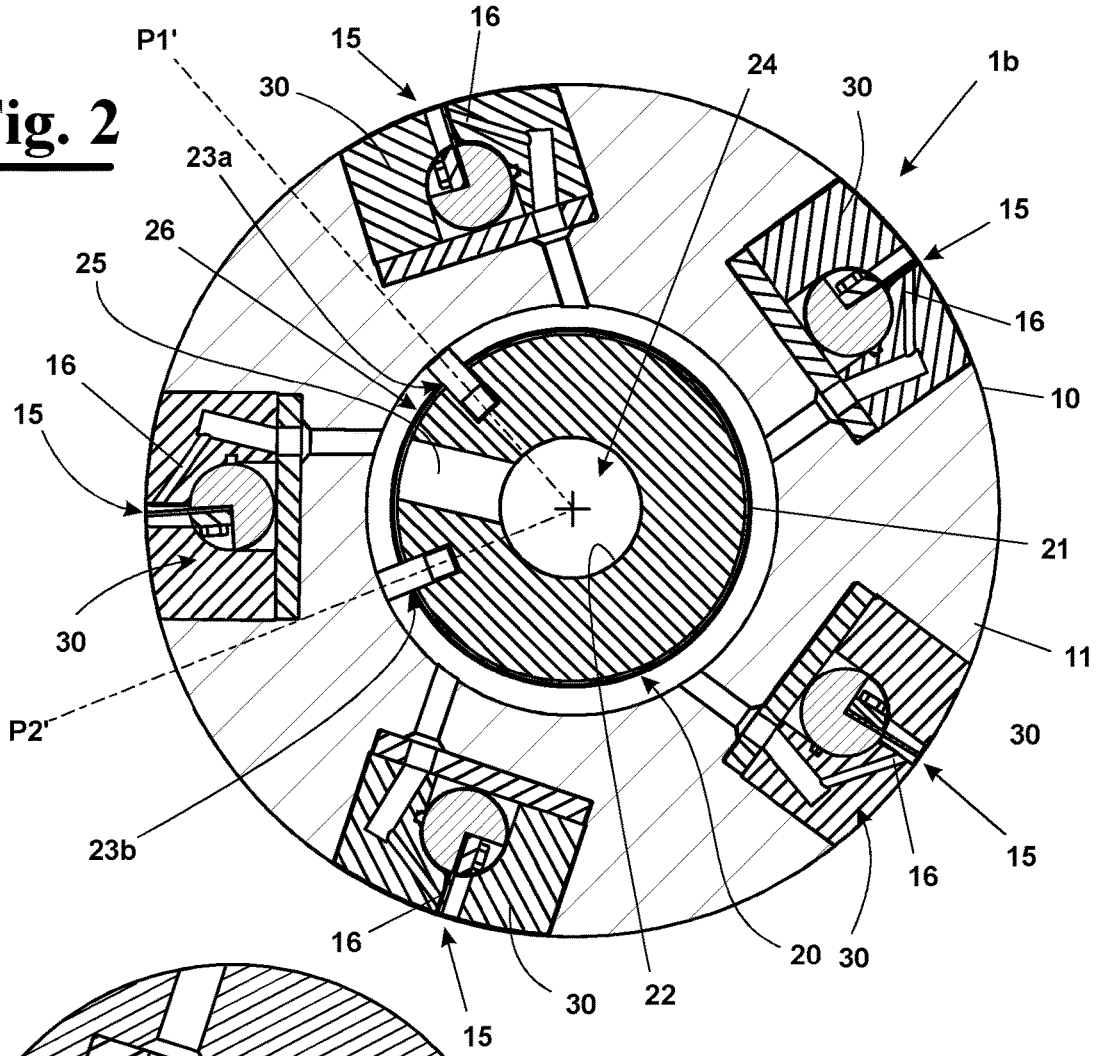

As for example diagrammatically shown in FIG. 2, in a preferred embodiment of the invention, each folding or interfolding roll, 1*a* and 1*b* comprises, furthermore, a fixed tubular body 20 positioned coaxially to the tubular body 10. The fixed tubular body 20, preferably cylindrical, is, in particular, provided with an external lateral surface 21 and an internal lateral surface 22 pneumatically connected one another by at least one aperture 25, in particular a longitudinal aperture, and a longitudinal cavity 24 pneumatically communicating to the aforementioned device for generating a predetermined vacuum degree.

More precisely, the vacuum distribution device comprises a suction chamber 26 pneumatically connected to the longitudinal cavity 24 and delimited by an internal lateral surface 12 of the tubular body 10 and, laterally, by a first and a second sealing element 23*a* e 23*b* arranged longitudinally to the tubular body 10, in to extend along respective radial directions. More in particular particular, the suction chamber 26 is configured to selectively pneumatically connect the aforementioned longitudinal cavity 24 to at least one suction hole 16 at a time between the aforementioned predetermined angular positions P1' and P2', in such a way to cause the or each sheet to be sucked by roll 1*a*, or 1*b* and, therefore, to assist the gripping of the same by the gripping member 15.

In particular, the machine equipped with the folding unit 100 as described above is arranged to work as "multi-fold" machine, in particular to produce "Z", or "W", or even with more panels, interfolded products. As known, in this type of paper converting machines, a single web of paper is worked and a succession of sheets, which are already partly overlapped to each other, arrives to the folding or interfolding unit from one only direction.

In an embodiment of the invention, the external surface 11 of each folding or interfolding roll 1*a*, or 1*b*, can be, furthermore, provided with a plurality of lateral suction holes 3 distributed longitudinally to the aforementioned tubular body 10. In particular, the aforementioned lateral suction holes 3, preferably oriented along respective radial directions, are selectively actuated by a secondary vacuum distribution device. More in particular, the secondary vacuum distribution device is configured to selectively connect at least one row of the aforementioned rows of lateral suction holes 3 to the aforementioned device for generating a determined vacuum degree, or to a supplementary device for generating a determined vacuum degree, at a predetermined second portion of the surface 11 of the folding or interfolding roll, 1*a*, or 1*b*, preferably comprised between a point arranged upstream of or coincident with the point of starting suction P1' and a point arranged downstream of or coincident with the point of ending suction P2'.

Figure 4:
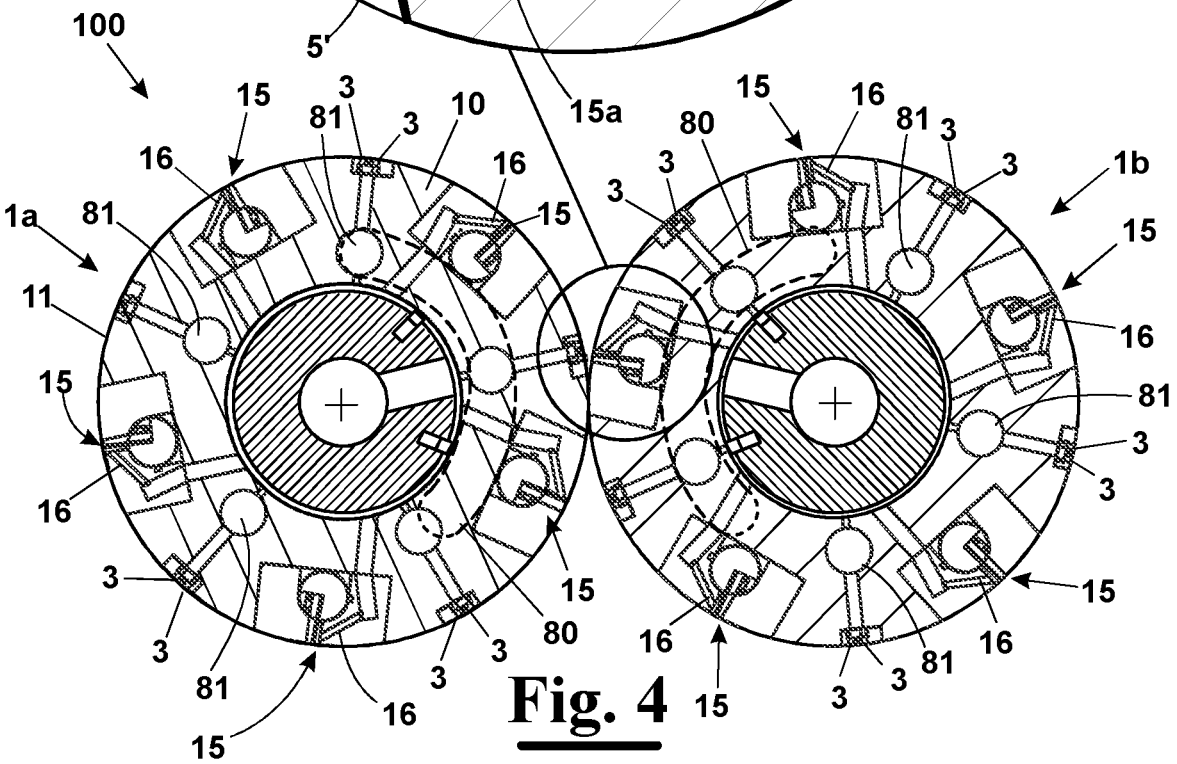
FIG. 4 diagrammatically shows a possible alternative embodiment of the folding or interfolding unit of FIG. 1 foreseen by the invention.

In particular, as diagrammatically shown in FIG. 4, each secondary vacuum distribution device can provide a longitudinal channel 81 made within the tubular body 10 pneumatically connected and associated respectively to the series of lateral suction holes 3, a shaped cavity, or lateral suction sector 80, associated to the tubular body 10 of each folding or interfolding roll 1*a*, or 1*b*, whose position is diagrammatically indicated in FIG. 4 with a broken line. More in particular, the lateral suction section 80 can be permanently connected to the secondary device for vacuum generating to selectively connect the rows of lateral suction holes 3. More precisely, by the lateral suction sector 80 associated to the tubular body 10, the rows of lateral holes 3 can be pneumatically connected with the aforementioned device for vacuum generating, only at determined angular positions of the holes. The lateral suction sector 80 is normally fixed, i.e. it does not rotate together with the tubular body 10, but can be movable, i.e. rotating about an axis coaxial to that of the tubular body 10, to carry out adjustments in such a way to modify the point of starting suction and the point of ending suction of the lateral suction holes 3.

More in particular, the aforementioned lateral suction sectors 80 can be "bell" vacuum distributors coaxially arranged at an end of the tubular body 10 of each folding or interfolding roll 1*a*, or 1*b*. In particular, each bell distributor device can be arranged coaxially to the tubular body 10, and is preferably fixed. Therefore, during the rotation of the tubular body 10, some zones, or sectors, are formed where the lateral suction holes 3 suck and hold, therefore, at least one sheet 5, in particular at the head 5*a*, or at the tail 5*b*, of the same, on the external surface 11 of the respective tubular body 10, some others, instead, where the sheet is not sucked (see FIG. 5). In this case, each gripping member 15 will be arranged to retain a sheet 5, in FIG. 5 the sheet 5, which is adhering to the surface 11 of the right roll 1*b*, in particular at the centre line, and at the same time the tail 5*b* and the head 5*a* of two following sheets 5' and 5" which are adhering to the surface 11 of the other roll, in FIG. 5 the left roll 1*a*, held up that instant by a respective lateral suction hole 3 of the same couple of longitudinal of lateral suction holes 3. In the FIGS. 6A and 6*b*, a folding or interfolding unit 100 is diagrammatically shown comprising a first and a second folding or interfolding roll 1*a* and 1*b* according to the invention, in the case of a "multi-fold" machine and, therefore, not provided with the aforementioned lateral suction holes 3. In this case, the machine will be therefore able to produce "Z", or "W", or having even more panels, interfolded products.

Figure 7A:
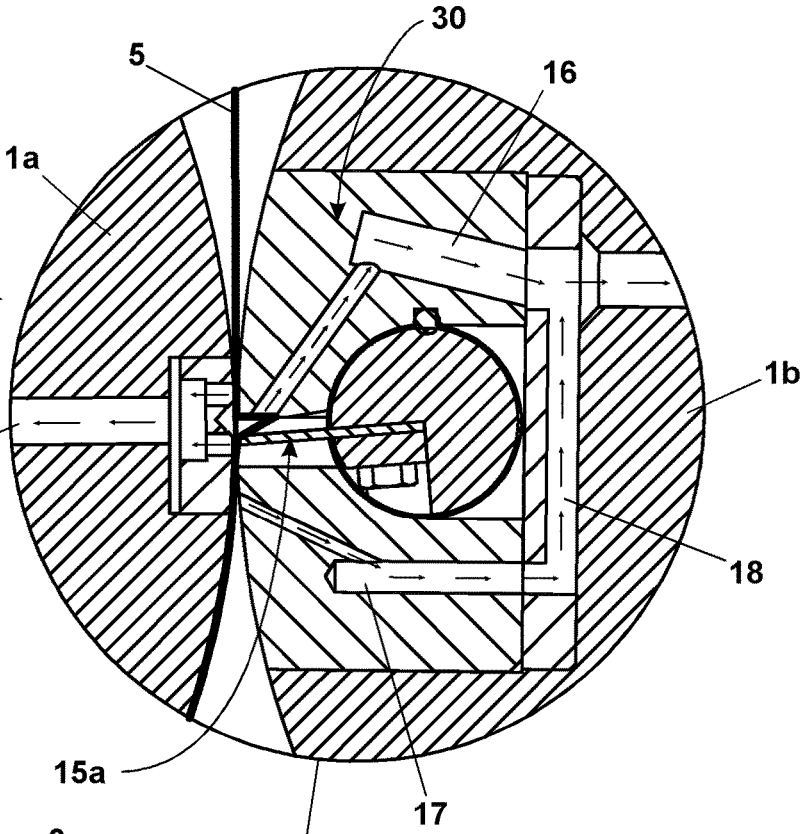
FIG. 7A diagrammatically shows still another possible alternative embodiment foreseen by the invention for the folding or interfolding unit of FIG. 1.
Figure 7B:
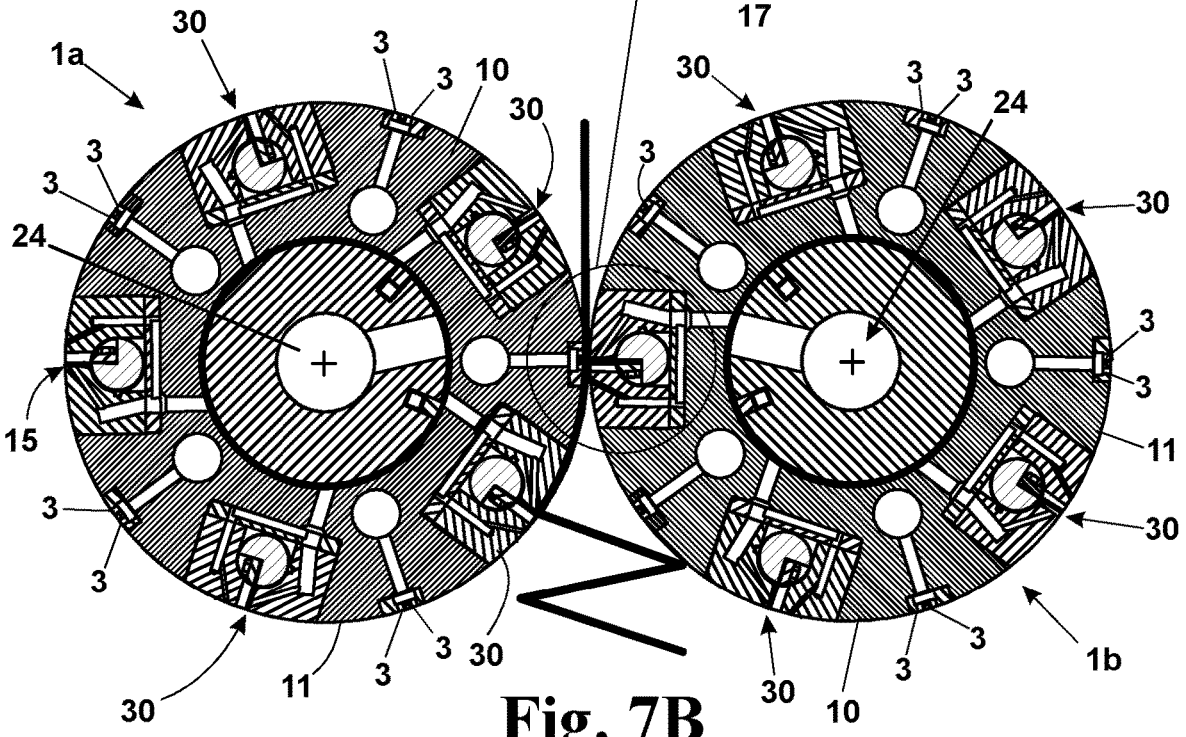
FIG. 7B shows an enlargement of the folding or interfolding zone of the folding or interfolding unit of FIG. 7A to highlight some technical characteristics.

In the embodiment diagrammatically shown in the FIGS. 7A and 7B, the folding or interfolding unit 100 comprises, instead, both the mechanical gripping groups 30 according to the invention, and the lateral suction holes 3. In this case, the folding or interfolding machine, equipped with tale folding or interfolding unit 100 will be able to work both as a "single-fold" machine, in particular for producing "V" interfolded products, and as "multi-fold" machine.

In particular, as known, the "single-fold" machines work two webs of paper, which are cut in such a way to obtain two staggered sequences of sheets that are, then, alternately fed to the folding or interfolding rolls 1*a* and 1*b*. In this way, each sheet coming from a first direction is overlapped, for half a sheet, to a portion of the sheet coming from a second direction, and vice versa, at the moment when the fold is carried out.

In an embodiment foreseen, a machine for folding or interfolding sheets of paper 5 can be equipped with a folding unit 100 comprising both the mechanical gripping groups 30 according to the invention, and the suction holes 3, and can be provided with a selection device, not shown in FIG. 9B for simplicity, configured to pneumatically disconnect, in particular by electric valves, the suction holes 3 and the aforementioned device for vacuum m generating. In this case, therefore, the machine for folding or interfolding sheets of paper 5 is highly flexible because it is able to work both as "single-fold" machine by connecting the suction holes 3 to the aforementioned device for vacuum generating, and as "multi-fold" machine, in the case diagrammatically shown in FIG. 7B, by pneumatically disconnecting the suction holes 3 and the aforementioned device for vacuum generating by means of the aforementioned selection device, or simply deactivating the device for vacuum generating.

Figure 3:
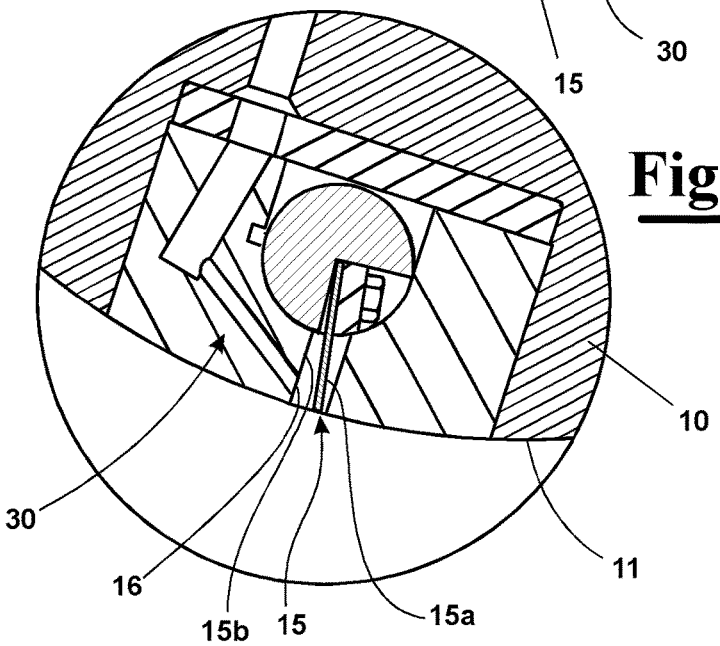
FIG. 3 shows an enlargement of a portion of the folding or interfolding roll of FIG. 2 to highlight some technical characteristics.
Figure 5:
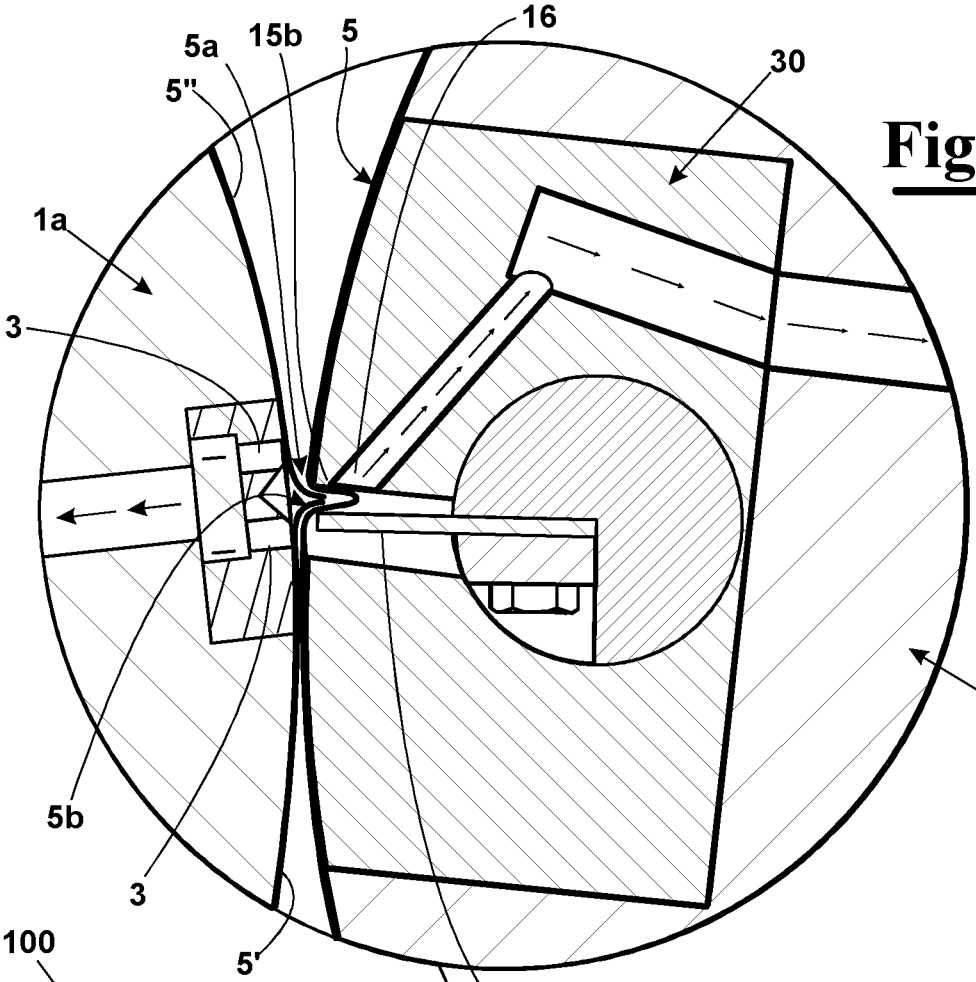
FIG. 5 shows an enlargement of the folding or interfolding zone of the folding or interfolding unit of FIG. 4 to highlight some technical characteristics.
Figure 6A:
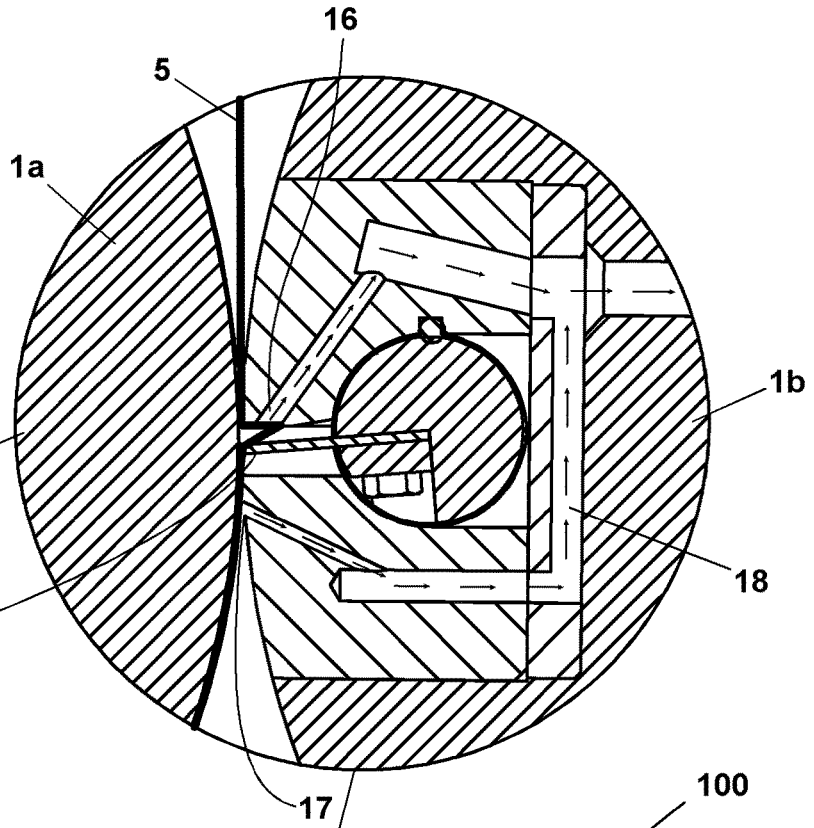
FIG. 6A diagrammatically shows another possible alternative embodiment foreseen by the invention for the folding or interfolding unit of FIG. 1.
Figure 6B:
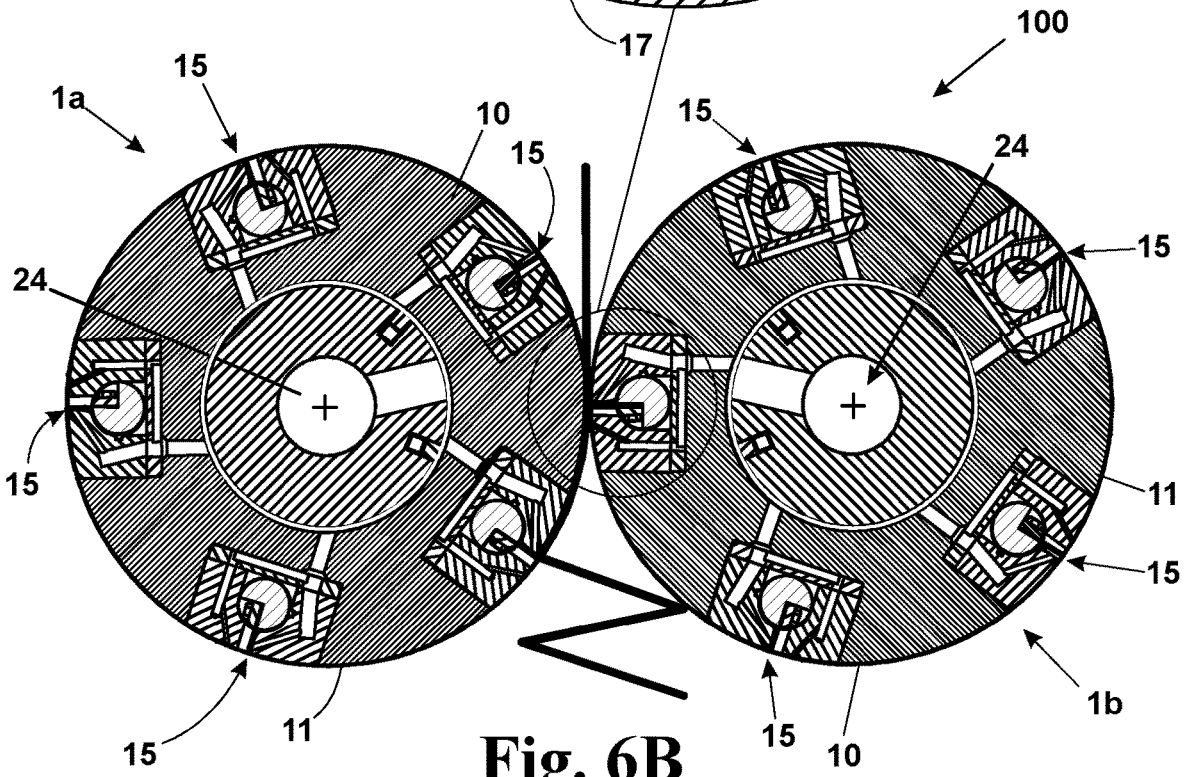
FIG. 6B shows an enlargement of the folding or interfolding zone of the folding or interfolding unit of FIG. 6A to highlight some technical characteristics.

As diagrammatically shown in the FIGS. 1 to 5, and in detail in the FIGS. 3 and 5, each suction hole 16 of a gripping group 30 is positioned on the fixed part 15*b* of the respective gripping member 15 and is, therefore, advantageously oriented towards the movable part 15*a* of this. In particular, each suction hole 16 is not positioned on the external lateral surface of the respective folding or interfolding roll 1*a*, or 1*b*.

In the alternative embodiments diagrammatically shown in the FIGS. 7A to 8B, each gripping group 30 according to the invention, in addition to the aforementioned suction hole 16, can comprise at least one secondary suction hole 17 positioned at the opposite side of the suction hole 16 with respect to the gripping member 15. In particular, each secondary suction hole 17 can be positioned at the external surface of the folding or interfolding roll 1*a*, or 1*b*, in particular downstream of the respective mechanical gripping member 15 with respect to the direction of rotation 110. More in particular, the secondary suction hole 17 can be pneumatically connected to the suction hole 16 associated to the same gripping member 15 by a connection duct 18. In this way, it is possible to pneumatically connect, or disconnect, both the suction hole 16 and the secondary suction hole 17 by the same vacuum distribution device.

Figure 8:
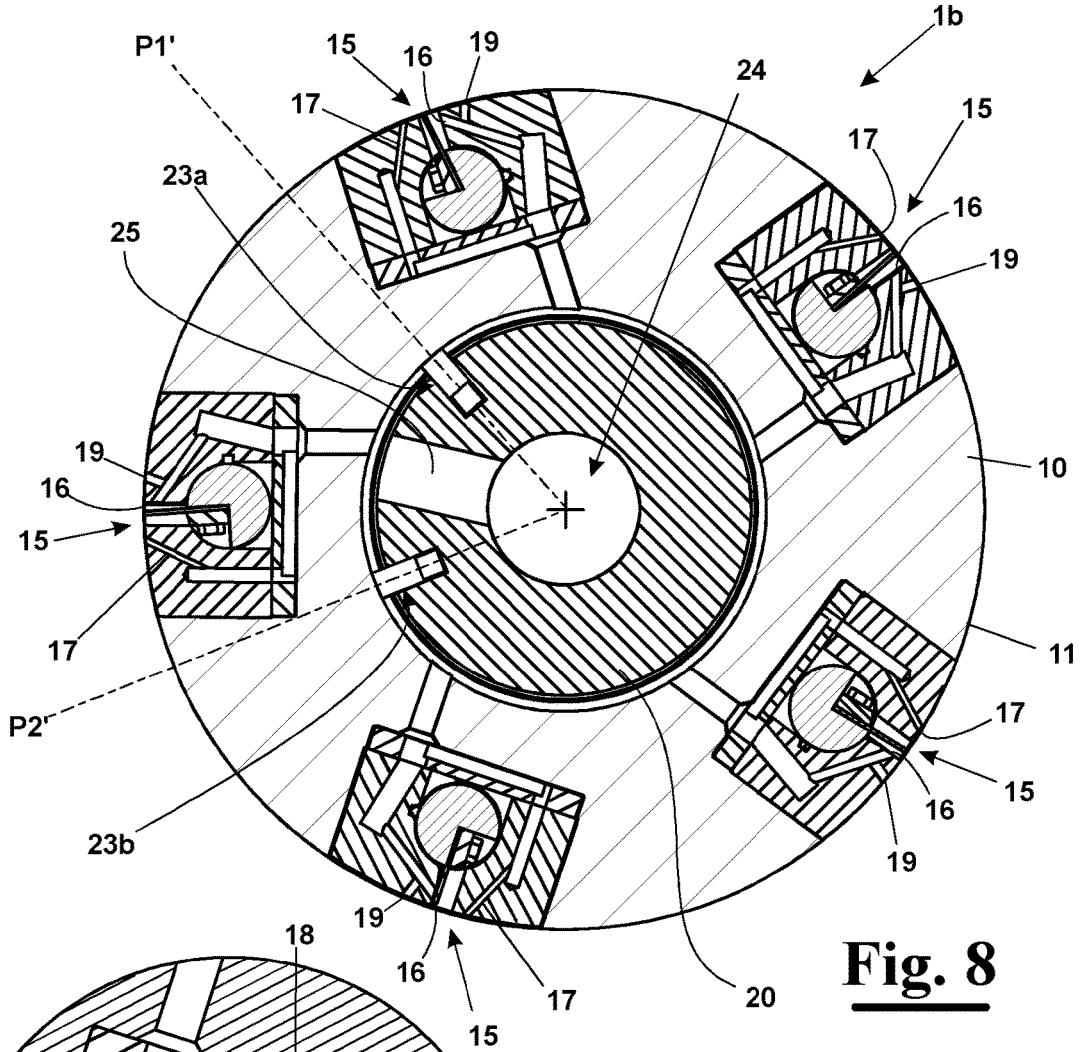
Figure 9:
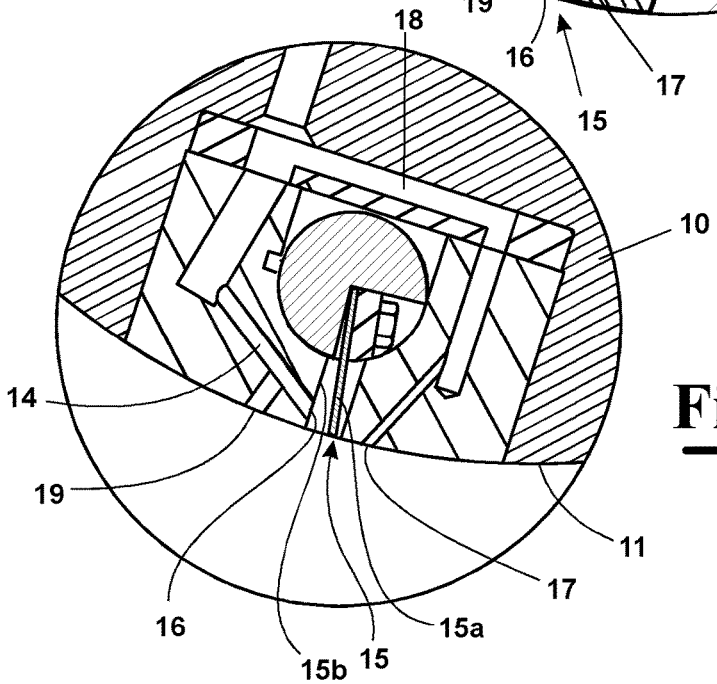
FIG. 9 shows an enlargement of a portion of the folding or interfolding roll of FIG. 8 to highlight some technical characteristics.
Figure 10A:
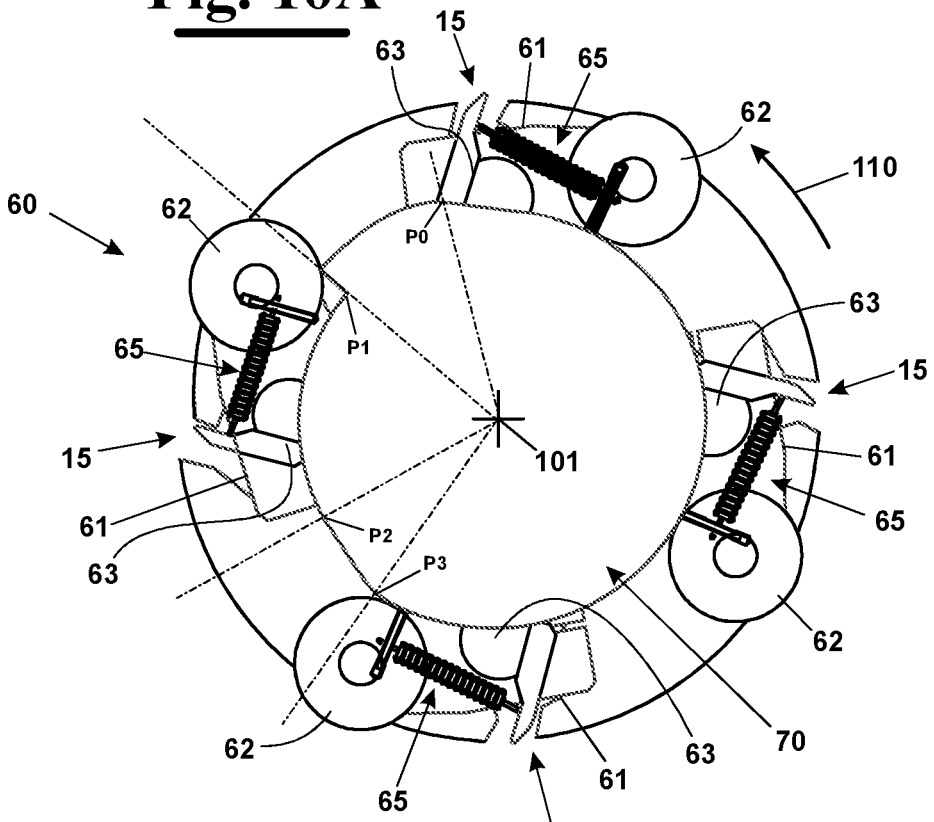
Figure 10B:
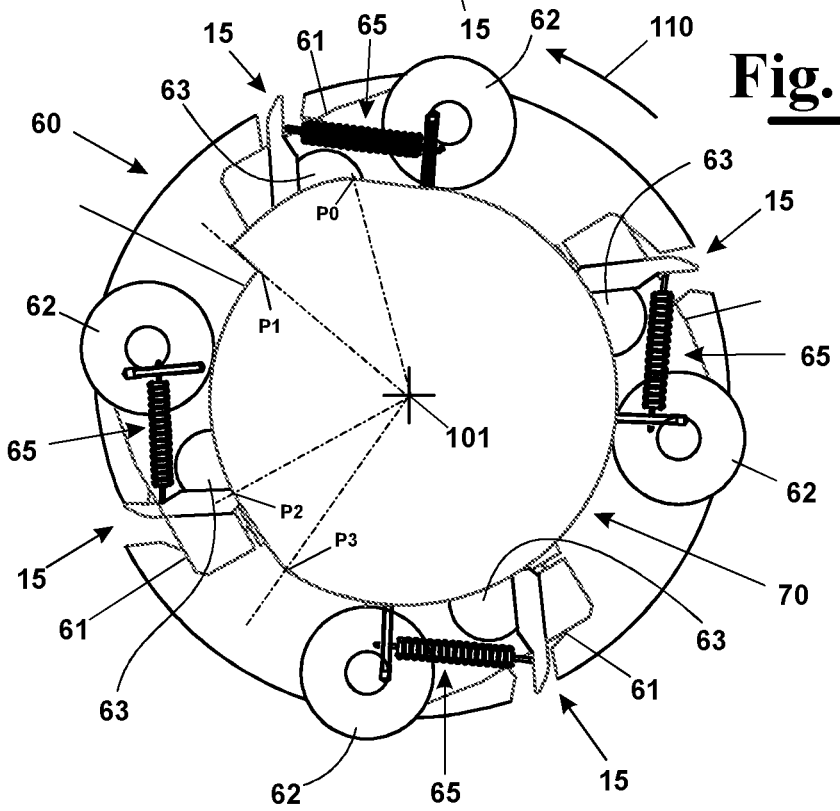

Advantageously, in a further embodiment foreseen and diagrammatically shown in the FIGS. 8 and 9, each gripping group 30 can comprise a further auxiliary suction hole 19 arranged at the same side of the respective suction hole 16, but at the external lateral surface 11 of the first and second folding or interfolding rolls 1*a*, and 1*b*. In particular, as it is shown in detail in FIG. 9, in this case, the suction duct 14 of each gripping group 30 is divided in two branches, one of which ends with the suction hole 16 arranged at an "inner" position of the roll 1*a*, or 1*b* with respect to the lateral surface 11 of the same, instead, the other ends with the further auxiliary suction hole 19 arranged, as anticipated above, at the surface 11 of the same roll 1*a*, or 1*b*. In particular, the further auxiliary suction hole 19 helps to stabilize the sheet 5 on the respective folding, or interfolding roll 1*a*, and 1*b* assuring that the same is correctly stretched on the external lateral surface 11 and introduced for a sufficient portion into the mechanical gripping member 15.

As diagrammatically shown in the enlargements of the FIGS. 3, 5, 7 and 9, the gripping member 15 can comprise a movable portion 15*a* arranged to move from/towards a fixed portion 15*b* to move from a closing position, which corresponds to the gripping configuration, to an opening position, which corresponds to the releasing configuration, and vice versa.

The folding or interfolding unit 100, according to the invention, can comprise, furthermore, an actuation group configured to cause a gripping member 15 at a time of the aforementioned plurality of gripping members 15 to move from the releasing configuration to the gripping configuration and vice versa at determinate angular positions of the tubular body 10 during its rotation about the longitudinal rotation axis 101.

In a possible embodiment foreseen, the aforementioned actuation group 60 can be configured to selectively cause, during rotation of the folding or interfolding roll, 1*a*, or 1*b*, a gripping member 15 at a time to move from the releasing configuration to the gripping configuration at a predetermined angular position of the tubular body 10, in order to allow the same to grip the, or each, worked sheet 5. In particular, the actuation group 60 can be, furthermore, configured to cause the gripping member 15 to move from the releasing configuration to the gripping configuration at another angular position that is reached during rotation of the respective folding, or interfolding roll 1*a*, or 1*b*. More precisely, the actuation group 60 can be configured to bring the gripping member 15 from the gripping configuration to the releasing configuration in such a way to allow the, or each, sheet 5 to be positioned at an engagement position arranged upstream of the movable portion 15*a* of the gripping member 15 and internal to the circumference of the tubular body 10 thanks to the contemporary suction action carried out by the or each respective suction hole 16. Then, the actuation group 60 is arranged to move the gripping member 15 back from the releasing configuration to the gripping configuration.

As diagrammatically shown in the FIGS. 10A to 10D, the actuation group 60 can comprise a cam device. In particular, each gripping member 15 is operatively connected to a support shaft 63 rotatably connected to the tubular body 10, preferably by bearings, not shown for simplicity. In this way, each shaft 63 is rotationally integral with the tubular body 10, but, at the same time, is able to rotate with respect to a respective rotation axis 163, to operate the opening and closing movements of the movable part 15*a* of the respective gripping member 15.

Advantageously, an end portion 61*a* of an actuation arm 61 fits on each support shaft 63. At the other end portion 61*b* the same actuation arm 61 is arranged to support a feeler member 62, in particular of mechanical type, that is able to rotate about a respective rotation axis 162. In particular, the feeler member 62 is arranged to slide along the guide member 70, or sliding race, during rotation of the folding or interfolding roll 1*a*, or 1*b* about its longitudinal axis 101. More in particular, the guide member 70 can be a cam configured in such a way to guide the feeler member 62, and, therefore, the respective actuation arm 61, along a predetermined trajectory. More precisely, the guide member 70 is, advantageously, fixed with respect to the respective folding, or interfolding roll 1*a*, or 1*b*, and is arranged to cause the movable portion 15*a* of the gripping member 15 to change inclination with respect to the fixed portion 15*b* at predetermined angular positions to cause the aforementioned movement of the gripping configuration to the releasing configuration. Advantageously, the feeler member 62 can be maintained in contact with the guide member 70 by a push member 65 or can be slidingly engaged into a shaped groove, also this not shown in the figure for simplicity. For example, the feeler member 62 can be provided with a rolling member, for example a roller, or a wheel, arranged to slide along the aforementioned guide member 70.

In the embodiment diagrammatically shown in the FIGS. 10A to 10D, the push member 65 is an elastic return member. In particular, the elastic return member 65 is configured to apply on a respective gripping member 15, in particular on the movable portion 15*a* of the same, an elastic return force arranged to oppose the movement from the gripping configuration to the releasing configuration caused by the opening stretch of the guide member 70. More precisely, the elastic strength of the return member 65 is configured to maintain the movable portion 15*a* in the gripping configuration (stretch from P1 to P2 of FIGS. 10A-10D), but is, however, smaller than the opening strength due to the push exerted by the guide member 70 on the feeler member 62 between the positions P3 and P0 of the guide member 70. In particular, between point P3 and point P0 the opening strength exceeds the elastic strength of the return member 65 and causes the actuation arm 61 and therefore the support shaft 63 to rotate, thus causing the rotation of the gripping member 15 to be opened. More precisely, at the stretch comprised between P0 and P1, the actuation group 60 is arranged to cause the gripping member 15 to move from a minimum opening position to a maximum opening position at point P1, where at a "step" of the guide member 70, the push strength on the feeler member 62 is suddenly reduced and the same is exceeded by the elastic strength of the return member 65, which brings the gripping member 15 in the gripping configuration at point P1" (diagrammatically shown in FIG. 10D) where it remains until the feeler member 62 reaches point P2, at which the gripping member 15 is in position P2" (diagrammatically shown in FIG. 10C).

In the stretch between P2 and P3, instead, the actuation group 60 is arranged to move the movable portion 15*a* of the gripping member 15 from the gripping configuration to the releasing configuration, where is far-removed from the fixed portion 15*b* (as can be deduced comparing FIGS. 10C and 10D). More precisely, the actuation group 60, during the sliding along the stretch comprised between P0 and P1 of the guide member 70 by the feeler member 62, progressively causes the movable part 15*b* of the gripping member 15 from an intermediate releasing configuration to position of maximum opening. Then, when the feeler member 62 runs the stretch comprised between P1 and P2 the return member 65 causes the movable part 15*b* of the gripping member 15 to move in the gripping configuration. Then, when the feeler member 62 arrives at position P3, the guide member 70 causes the movable part 15*b* of the gripping member 15 to move from the gripping configuration to a starting releasing configuration and, finally, when the feeler member 62 reaches position P4, the actuation group 60 causes the movable portion 15*b* of the gripping member 15 to move in an intermediate releasing configuration, which is maintained until the feeler member 62 reaches again position P0. In this way at point P2 of the feeler member 62 and, therefore, at point P2" of the gripping member 15, the sheet 5, as well as the tail 5*b* and the head 5*a* of two following sheets 5' and 5" are released.

In an embodiment of the invention, the actuation group can comprise a desmodromic cam configured to cause the gripping member 15 to move from the releasing configuration to the gripping configuration and the oppose movement, and therefore from the gripping configuration to the releasing configuration. In particular, in this case, the guide member 70 comprises a stretch where is arranged to cause the movable portion 15*a* to move from the gripping configuration to the releasing configuration and a stretch where is arranged to cause the movable portion 15*a* same to move from the e gripping configuration to the releasing configuration.

Figure 11:
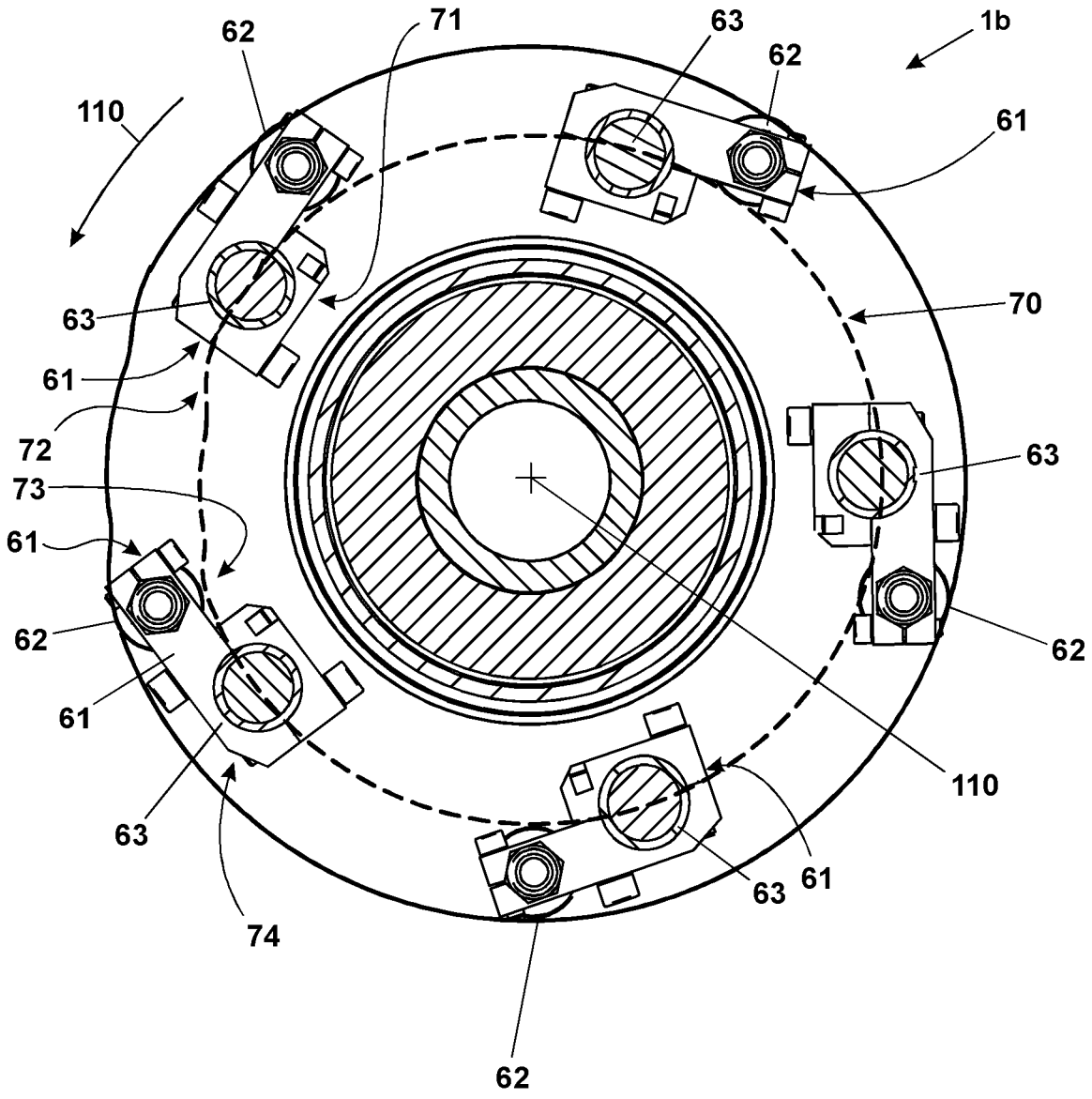
FIG. 11 diagrammatically shows a transverse section view of an alternative embodiment of the actuation group of a folding or suction roll of the FIGS. 10A-10D.

As diagrammatically shown in FIG. 11, the guide member 70 can be a shaped groove where each feeler member 62 of each arm 61 is arranged to slide in such a way to be guided along a predetermined trajectory, during rotation of the respective folding, or interfolding roll 1*a*, or 1*b*. In particular, each feeler member 62 can comprise a first and a second rolling member, each of which configured to slide on a respective sliding race of guide member 70, which forms the shaped groove (in FIG. 11 only one rolling member and the respective sliding race are shown for clarity reasons). In this way, the feeler member 62 can operate the opening of the gripping member 15 by interaction of the first rolling member with one of the two races of the guide member 70. Vice versa, the closing of the gripping member 15 is obtained by interaction of the second rolling member of the feeler member 62 with the second race of the guide member 70. More precisely, the shaped groove 70 has a geometry such that when the gripping member 15 arrives at a predetermined angular position P0, the movable portion 15*a* begins to gradually move away, in particular by rotating, from the fixed portion 15*b*. In particular, when the first rolling member of the feeler member 62 moves along an opening stretch 71 of the first race of the shaped groove 70 causes the arm 61 and, therefore, the support shaft 63 to rotate in order to cause the gripping member 15 to open. The shaped groove 70 provides, then, a closing stretch 72 of a second race having a geometry such that when the second rolling member of the feeler member 62 arrives at another angular position, causes the movable portion 15*a* to close towards the fixed portion 15*b*, in such a way to retain the, or each, worked sheet 5. Then, when during rotation of roll 1*a*, or 1*b*, about its longitudinal axis 101 the first rolling member of the feeler member 62 arrives at a following predetermined angular position of a following second opening stretch 73 of the first race of the shaped groove 70 is forced to cause again the gripping member 15 to open, in such a way to allow the same to release the sheet, to move the movable portion 15*a* back to a predetermined distance from the fixed portion 15*b* which is maintained up to reach a further angular position of a third opening stretch 74 of the shaped groove 70 where the gripping member 15 is maintained open. Therefore, in this case, the actuation group 60 provides a shaped groove 70 comprising at least one opening stretch 71 and one closing stretch 72 shaped in such a way to cause, respectively, the mechanical gripping member 15 to open and close during rotation of the respective folding, or interfolding roll, 1*a*, or 1*b*. More precisely, analogously to what described above with reference to the FIGS. 10A to 10D, at the opening stretch 71, the guide member 70 is configured in such a way to move the movable portion 15*a* of the gripping member 15 from an intermediate releasing configuration to a position of maximum opening, and then, at the closing stretch 72, and in particular at a closing point P1, causing a sudden movement to the gripping configuration and then at the stretch 73, the movement from the gripping configuration to a starting releasing configuration and, at the end, at the stretch 74 in an intermediate releasing configuration which is maintained up to move again at the opening stretch 71.

In an embodiment foreseen, the movable portion 15*a* of each gripping member 15 can be made of a flexible material, advantageously in harmonic steel, in such a way to elastically move from the gripping configuration to the releasing configuration and vice versa.

Figure 12:
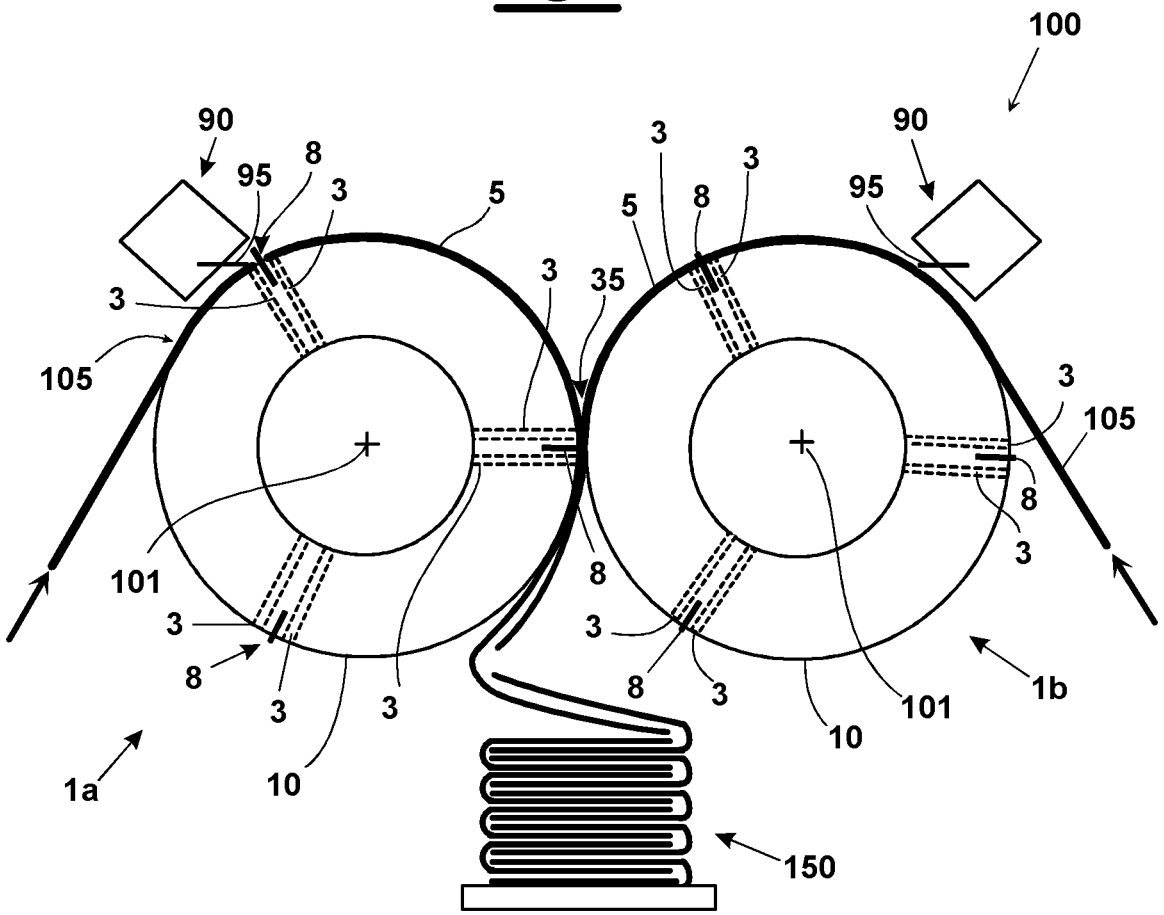
FIG. 12 diagrammatically shows another alternative embodiment foreseen by the invention for the folding or interfolding unit according to the invention.

In the further embodiment of the invention, diagrammatically shown in FIG. 12, each folding or interfolding roll, 1*a* and 1*b* furthermore comprises, a respective cut device 90 provided with at least one cut blade 95. In this case, each first and second folding or interfolding roll, 1*a* and 1*b* is respectively, provided, in particular between a couple of lateral suction holes 3, as diagrammatically described above with reference to the embodiments of FIGS. 4 and 8, with a first and a second plurality of counter-blades 8 distributed along a respective tubular body 10. More precisely, the counter-blades 8 of each roll 1*a* and 1*b* are arranged to operate in combination with the respective cut blade 95 to divide a first and a second web of paper 105*a* and 105*b*, or similar products, into a first and a second plurality of sheets 5. For clarity reasons, in FIG. 12 the gripping members 15 and the respective suction holes 16 are not shown, but they can be however of the type described above with reference to the FIGS. 1 to 12. In particular, in this case, the counter-blade 8 of a roll, for example of roll 1*a*, at the folding or interfolding zone, 35 can act as introduction member and, therefore, assist the introduction of the, or each, worked sheet 5 within the gripping member 15 of the other roll, for example of the roll 1*b*.

Also in the embodiment of FIG. 12 are present, but not shown for simplicity, both the first and the second plurality of removing fingers 40*a* and 40*b* as well as the first and the second plurality of separation members 45*a* and 45*b* having the same functionality described above.

According to another aspect of the invention, as diagrammatically shown in the FIGS. 13A to 19 an adjustment group 50 can be provided configured to move the aforementioned actuation group 60 with respect to the respective folding, or interfolding roll 1*a*, or 1*b*. More precisely, the adjustment group is arranged to selectively position the aforementioned actuation group 60 in a predetermined spatial position to which correspond a first and a second predetermined angular position P1" and P2" of the gripping point and releasing point. In particular, with "spatial position" of the actuation group 60 is intended the set of the angular positions of the single points which form the same.

Analogously to what has been described above with reference to the FIGS. 10A to 10D, the actuation group 60 can comprise a guide member 70 configured to guide each mechanical gripping member 15 at a time along a predetermined trajectory during rotation of the respective folding, or interfolding roll 1*a*, or 1*b*, about the respective longitudinal axis 101. Preferably, the guide member 70 comprises at least one closing stretch 72 arranged to cause each mechanical gripping member 15 to move from the releasing configuration to the gripping configuration, in particular at the closing point P1, and at least one opening stretch 73 arranged to cause each mechanical gripping member 15 to move from the gripping configuration to the releasing configuration.

As diagrammatically shown in FIG. 13A, each adjustment group 50 is configured to rotate the guide member 70 with respect to the respective folding, or interfolding roll 1*a*, or 1*b*, about a respective rotation axis 170, preferably coincident with the respective longitudinal axis 101, to position the guide member 70 in the predetermined spatial position.

In the example that is shown in FIG. 13A, the adjustment group 50 provides a toothed sector 58 integral to the aforementioned guide member 70. The toothed sector 58 is operated by a worm screw 57 fitting on a rotation shaft 56 operated by a motor 55, advantageously, an electric motor. This can be operated to rotate the rotation shaft 56 in a first direction 156, or in a second direction 156' opposite to the first, in such a way to cause the guide member 70 to rotate, respectively, in a first direction of rotation 158 (FIGS. 13A and 13B), or in a second direction of rotation 158' opposite to the first (FIGS. 14A and 14B).

The adjustment group 50 can be, generally, configured to cause the guide member 70 to rotate. For example, the adjustment group 50 can provide linear motors, pistons and similar mechanical, or electric, or hydraulic, or pneumatic elements.

More in detail, in the case that is shown in the FIGS. 13A and 13B, the guide member 70 is rotated in a direction concordant with the direction of rotation 110 of the folding or interfolding roll, 1*a*, or 1*b*. Therefore, in this case, as diagrammatically shown in FIG. 13B, both point P1 and point P2 of the guide member 70 are moved forward and, therefore, also the gripping point P1" and the releasing point P2", for what described above with reference to the FIGS. 10A to 10D.

Figure 14A:
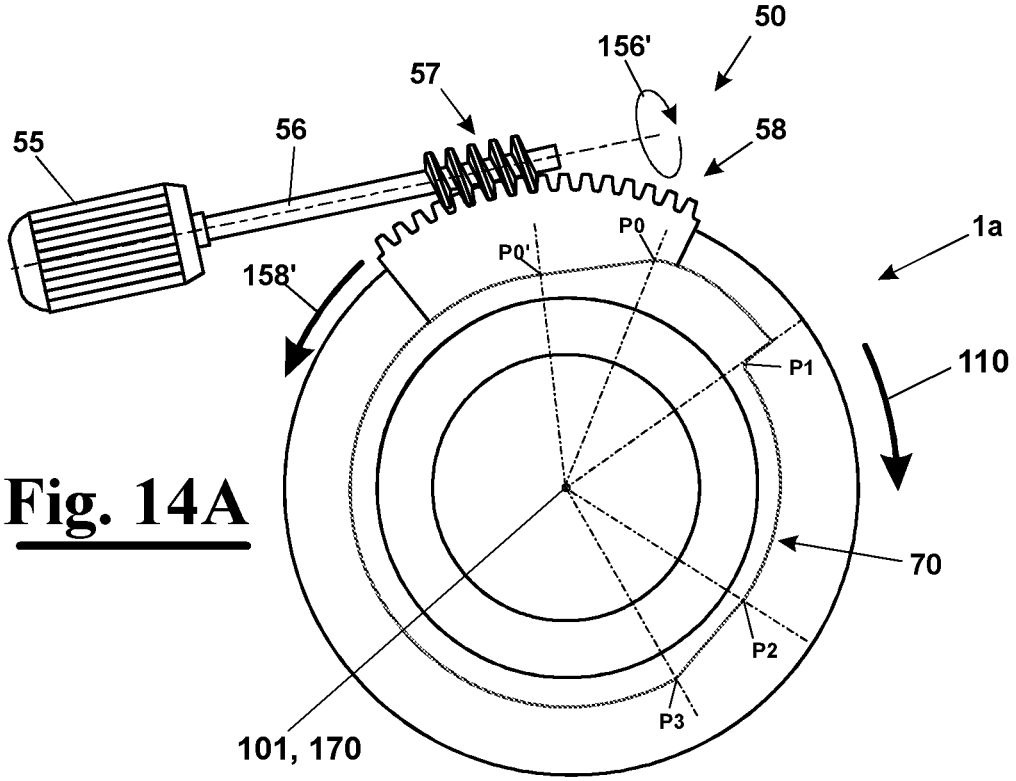
Figure 14B:
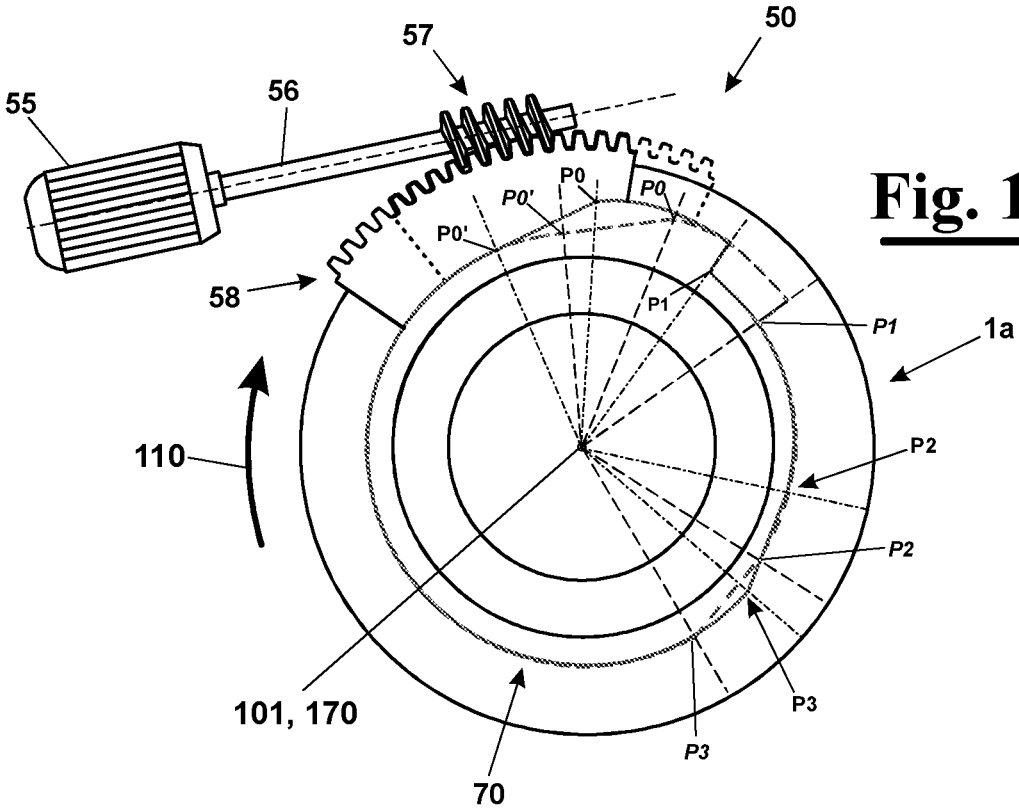

In the case that is shown in the FIGS. 14A and 14B, instead, the motor 55 is operated to rotate the rotation shaft 56 in a second direction 156' opposite to the previous one, in such a way to cause the toothed sector 58 to rotate in a second direction of rotation 158' opposite to the direction of rotation 158 and in particular a direction opposite to the direction of rotation of the folding or interfolding roll, 1*a*, or 1*b*. Therefore, in this case, as diagrammatically shown in FIG. 14B, both point P1 and point P2 of the guide member 70 are moved backward and, therefore, also the gripping point P1" and the releasing point P2".

Figure 15A:
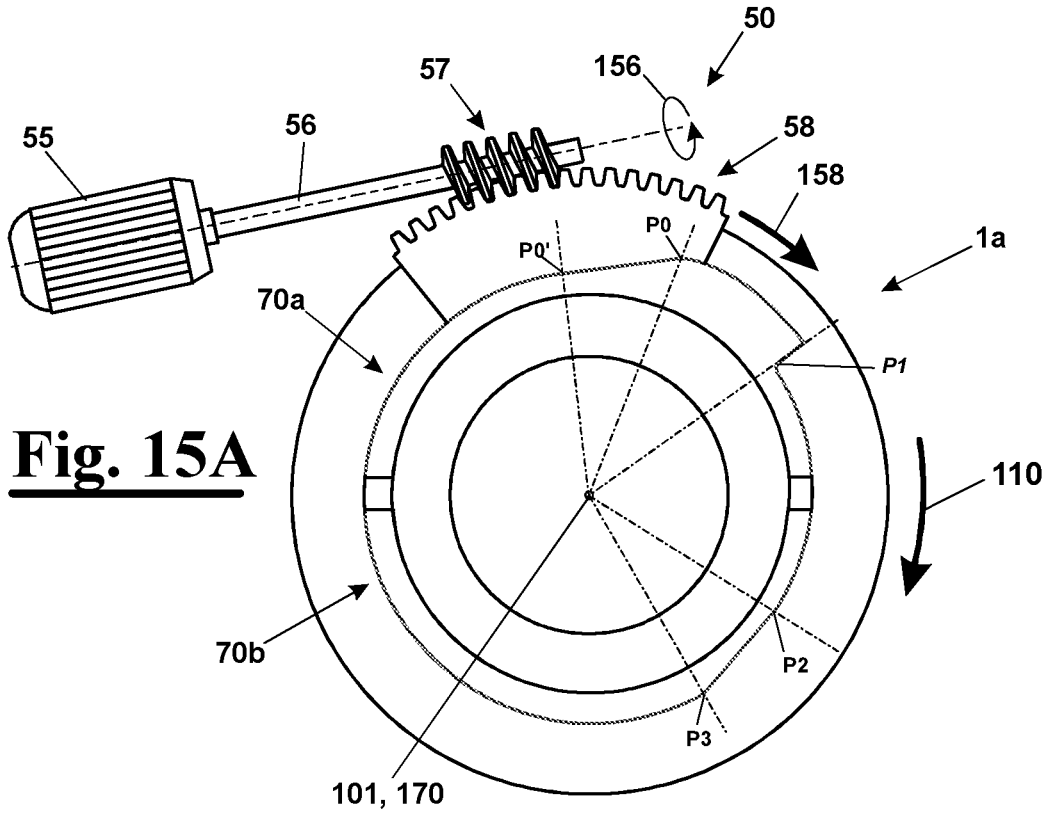
FIGS. 15A e 15B diagrammatically show another embodiment of a folding or interfolding roll, according to the invention in two different working configurations.
Figure 15B:
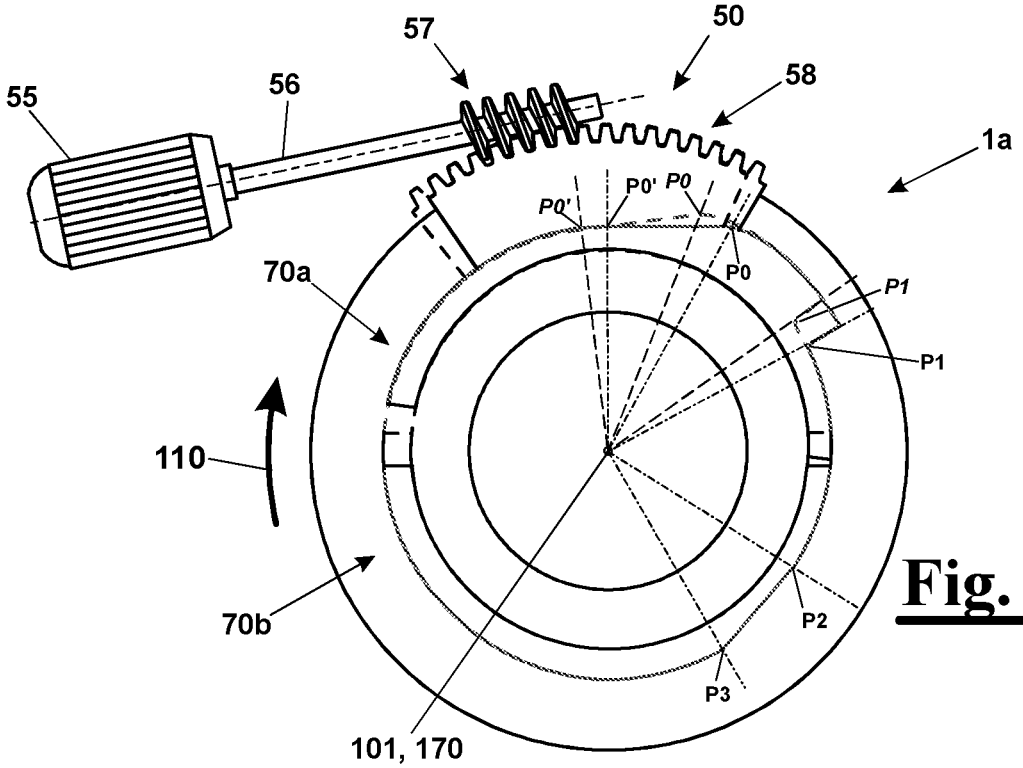

As diagrammatically shown in the FIGS. 15A and 15B, each guide member 70 can comprise a first portion 70*a* comprising the point P1 at which the closing of the pliers 15 is caused and then remain closed for all the closing stretch 72, and at least a second portion 70*b* provided with the opening stretch 73. In particular, in this case, at least one between the first and the second portion 70*a* and 70*b* of the guide member 70 (in the case of FIGS. 15A and 15B the first portion 70*a*) can be configured to move with respect to the respective folding, or interfolding roll 1*a*, or 1*b*, to be arranged in a predetermined spatial position. Analogously to what has been described above with reference to the FIGS. 13A to 14B, depending on whether the movable portion is moved forward or backward with respect to the reference position of FIG. 15A, also the gripping point P1", or the releasing point P2", are moved forward or backward depending on whether the movable portion is the first portion 70*a*, as in the case shown in FIGS. 15A and 15B, or the second portion 70*b*.

Figure 16:
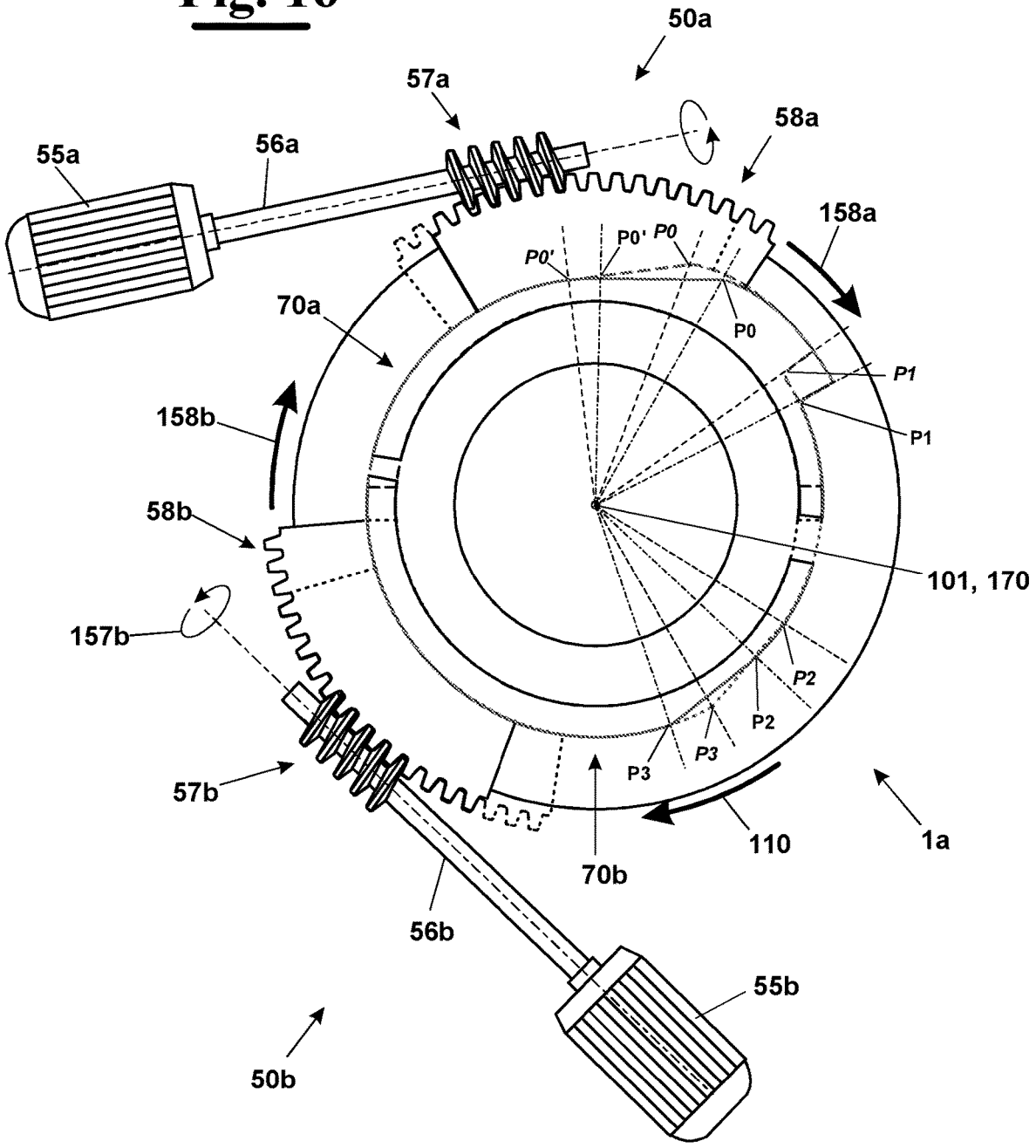
FIG. 16 diagrammatically shows another embodiment of a folding or interfolding roll, according to the invention.

In the further alternative embodiment diagrammatically shown in FIG. 16, both the first and the second portion 70*a* and 70*b* of the guide member 70 are provided able to independently move one with respect to the other. In particular, the adjustment group 50, in this case, can comprise a first displacement device 50*a* configured to rotate the first portion 70*a* of the guide member 70 with respect to the respective folding, or interfolding roll 1*a*, or 1*b*, about the aforementioned longitudinal axis 101 to position the same in a first predetermined spatial position, and a second displacement device 50*b* configured to rotate 1*a* second portion 70*b* of the guide member 70 with respect to the respective folding, or interfolding roll 1*a*, or 1*b* to position the same in a second predetermined spatial position, in such a way to adjust the angular position of point P1 of the guide member 70 and, therefore, of the gripping point P1", and the angular position of P2 and, therefore, of the releasing point P2" independently from each other.

Figure 17:
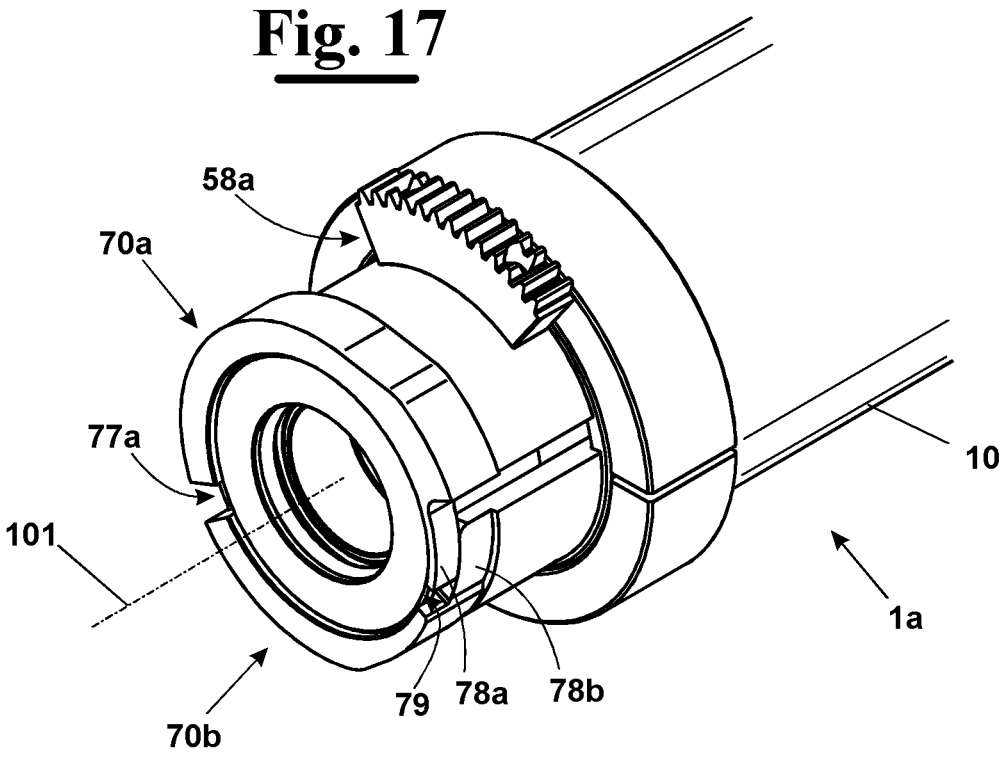
FIGS. 17 e 18 diagrammatically show perspective side elevation views of the folding roll of FIG. 16 to highlight some technical characteristics.
Figure 18:
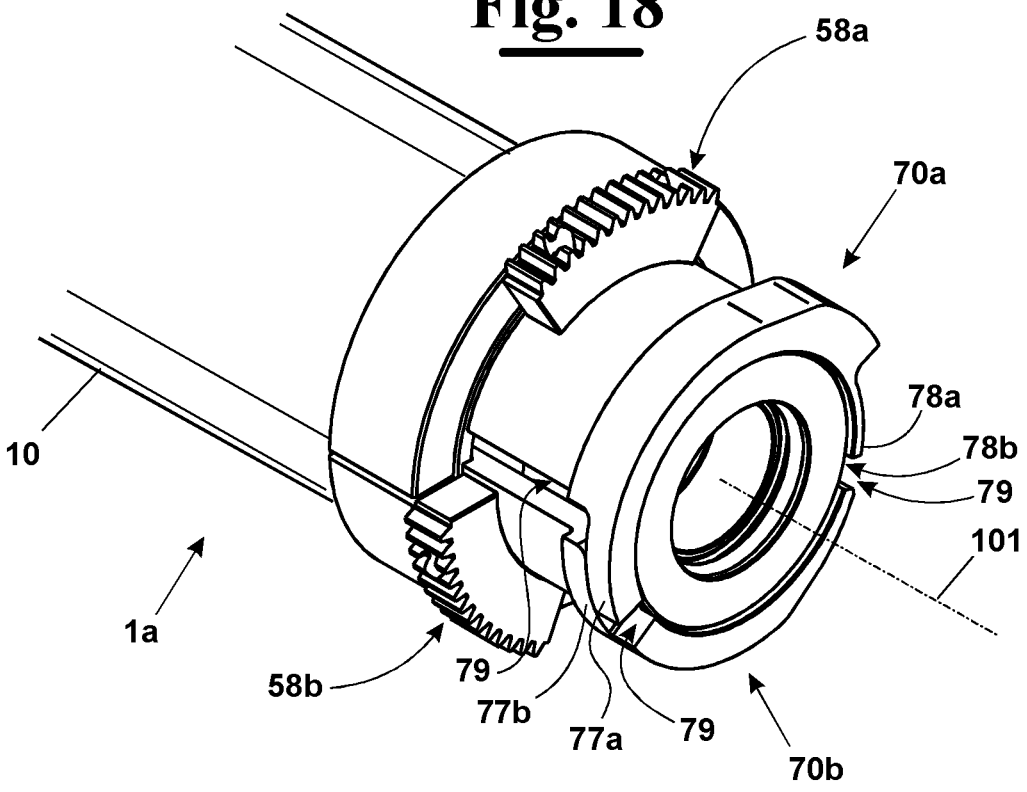
Figure 19:
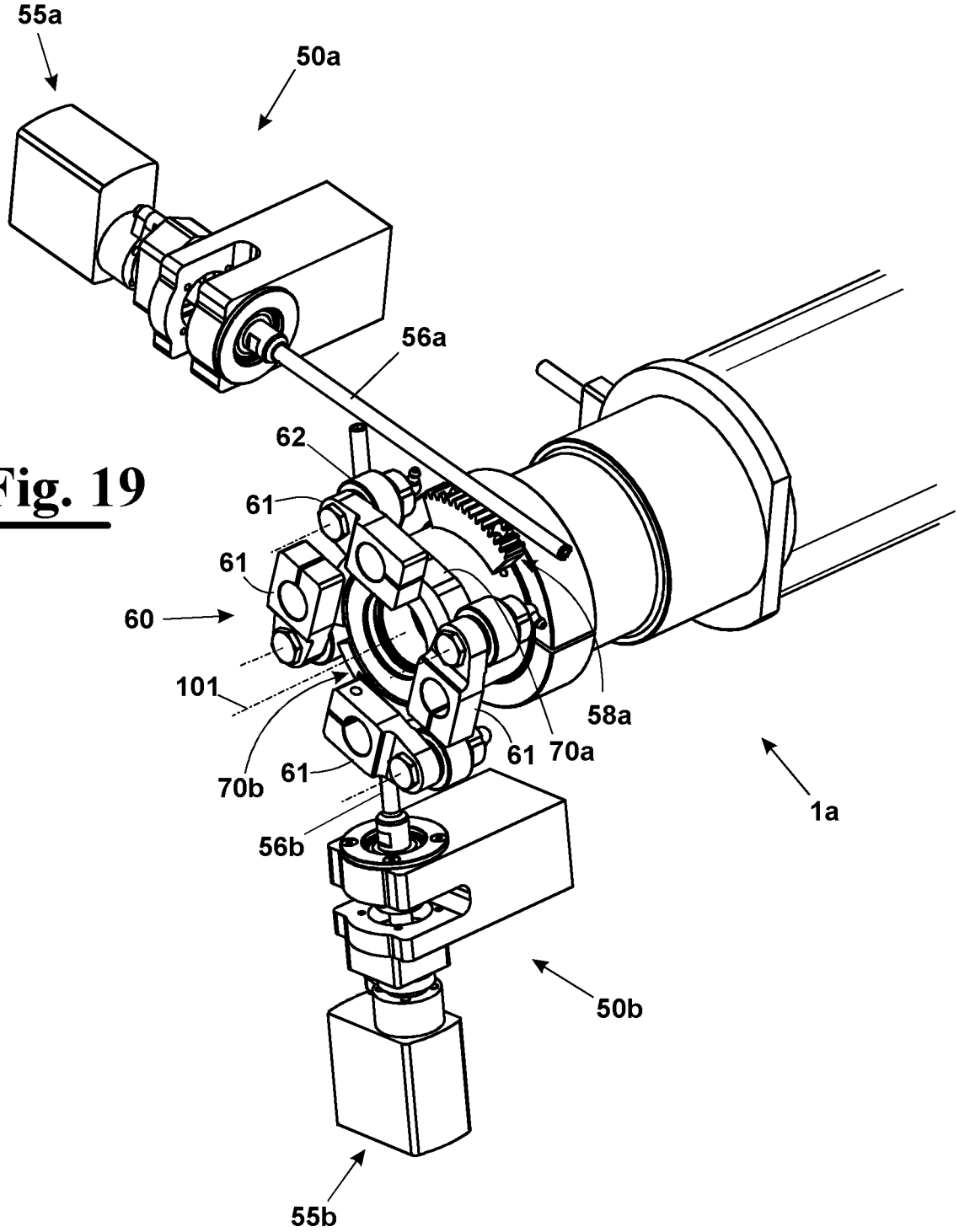
FIG. 19 diagrammatically shows a perspective side elevation view of the folding roll of FIGS. 17 and 18 where the actuation group is visible.

As diagrammatically shown in the FIGS. 17 and 18, the first portion 70*a* of the guide member 70, or cam guide member, integral to the toothed sector 58*a* and the second portion 70*b* of the guide member 70 same integral to the toothed sector 58*b*, can have respective overlapped first portions 77*a* and 77*b* arranged to overlap to each other preferably along a longitudinal direction at respective first ends, and second overlapped portions 78*a* and 78*b* also these, advantageously, arranged to overlap to each other, preferably along a longitudinal direction at respective second ends to allow the aforementioned relative motion, in particular a relative rotation about axis 101. This is, advantageously, possible because there is a determined distance 79 between the first and the second portion 70*a* and 70*b*, in particular between the respective end portions.

The embodiments of the folding or interfolding unit described above with reference to the FIGS. 13A to 19 allows, therefore, to set a determined gripping and/or releasing point P1" and P2". This type of configuration can be used also in the cases shown in the FIGS. 10A to 10D simply replacing the guide member 70 formed by a single piece with a guide member 70 formed by the two portions 70*a* and 70*b*, in case each with the respective adjustment group 50*a* and 50*b*.

Analogously, with reference to the embodiment of FIG. 11, it is possible to adjust the gripping and/or the releasing point P1" and P2" by rotating one or both the sliding tracks forming the guide member 70 of the respective actuation group 60. The two tracks are mounted in order to be movable one with respect to the other, each rotating about an axis preferably coincident to the longitudinal axis 101. Each track is associated to an adjustment group 50 which can be analogous to that previously described. In particular, the first track acts on the first rolling member of the feeler member 62 to cause the actuation arm 61 and, therefore, the respective support shaft 63 to rotate causing an opening movement of the gripping member 15 (clockwise rotation with reference to FIG. 11). The second track acts on the second rolling member of the feeler member 62 to cause the actuation arm 61 and, therefore, the respective support shaft 63 to rotate thus causing a closing movement of the gripping member 15 (counter-clockwise rotation with reference to FIG. 11). For example, the first track can comprise the opening stretches 73, 74 whilst the second track comprises the closing stretch 72. In this way, by the first adjustment group 50*a* associated to the first track it is possible to adjust the angular position of the releasing point P2" rotating the tracks 73 and 74, whilst by the second adjustment group 50*b* associated to the second track, it is possible to adjust the angular position of the gripping point P1" by rotating the stretch 72. It is clear that having two distinct tracks, each of which associated to a respective adjustment group 50, allows to optimally and independently adjust at least one between the gripping point P1" and the releasing point P2" from each other.

In this way, it is possible to anticipate, or retard, in general and/or with respect to a reference working configuration, the instant at which the, or each, sheet of paper 5 is gripped by the gripping member 15 and/or the instant at which the web or sheet of paper 5 is released by the gripping member 15. The motors 55*a* and 55*b* can be, advantageously, connected and operated by a central control unit, not shown for simplicity, which can adjust the gripping point P1" and the releasing point P2" both at the starting up of the folding or interfolding unit 100, and during working conditions. For example, the positions of the gripping point and of the releasing point P1" and P2" can be selected depending on the type of product and/or paper that is worked, in particular the paper weight and/or the speed of the machine. The central control unit can continuously displace the gripping point and/or the releasing point P1" and P2" depending on the speed of the folding or interfolding unit 100 or at threshold speed values that means displacing the gripping point and/or the releasing point P1" and P2" each time that determined threshold speed values are exceeded. The threshold speed values can be determined depending on the type of interfolded product to be produced and/or the paper weight of the worked paper. In this way the machine is constantly and automatically adjusted in order to work very well.

In an embodiment of the invention, in addition to, or alternatively to an automatic adjustment of the position of the gripping point P1" and/or of the releasing point P2", it is also foreseen that the adjustment can be carried out by an operator acting directly on an interface man-machine, also called HMI, connected to the central control unit to adjust by hands the folding or interfolding unit 100. The advantage, in this case, is that the operator can set extremely well the folding or interfolding unit 100 without entering the machine. The folding or interfolding unit 100 comprises therefore a plurality of mechanical gripping groups 30, which rotates integrally to the folding rolls 1*a*, 1*b*. The mechanical gripping groups 30 are distributed at a constant distance one from the following one, along the circumference of the folding roll 1*a*, 1*b* in such a way that the distance between the mechanical gripping group 30 and the following one corresponds to the length of a sheet 5. In this way each gripping member 15 associated to the mechanical gripping group 30 is opened or closed depending on its angular position with respect to the guide member 70. The adjustment groups 50 of each folding roll 1*a*, 1*b* allows, therefore, to adjust the angular position of the respective guide members 70 of each folding roll 1*a*, 1*b* thus allowing to set the gripping and/or releasing points P1" and P2" of all the pliers members 15 of one or both the folding rolls 1*a*, 1*b* setting very well the folding or interfolding unit 100.

Figure 20:
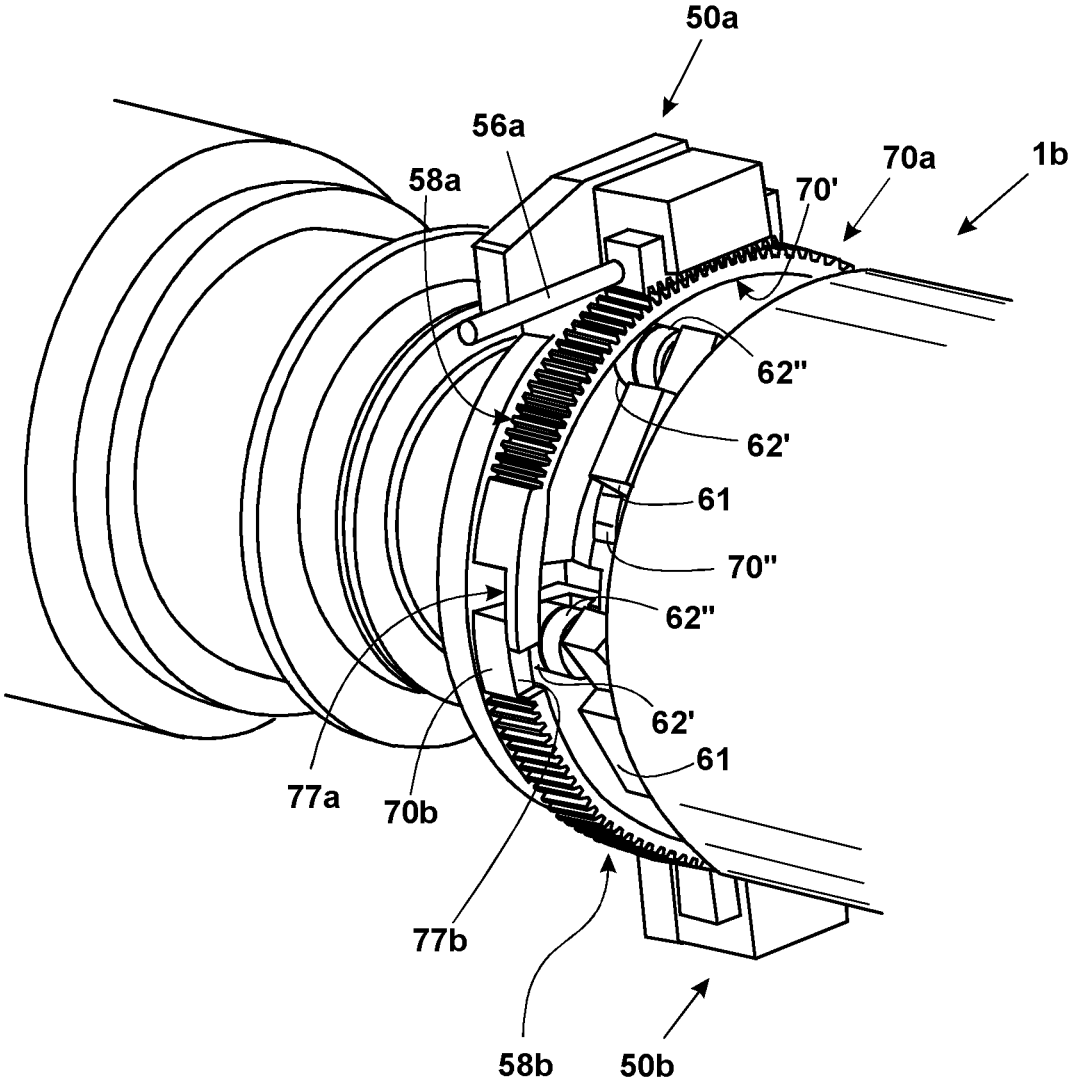
FIG. 20 diagrammatically shows a perspective partly sectioned view of still another embodiment of the invention.

As diagrammatically shown in the further embodiment of FIG. 20, the shaped guide member 70 can comprise a first sliding track 70', advantageously provided with the closing stretch 72, and arranged to guide a first feeler member 62' of an actuation arm 61 and a second sliding track 70", advantageously comprising the opening stretch 73, and arranged to guide a second feeler member 62", preferably coaxially arranged to the first feeler member 62', of the same actuation arm 61. In this case, the adjustment group 50 is, preferably, configured to adjust the spatial position of at least one between the first and the second sliding track 70' and 70" with respect to the respective folding, or interfolding roll 1*a* and 1*b*. In the example of FIG. 20, the adjustment group 50 comprises a first displacement device 50*a* configured to adjust the spatial position of the first sliding track 70' and a second displacement device 50*b* configured to adjust the spatial position of the second sliding track 70". In this way, therefore, it is possible to adjust the spatial position of the two tracks 70' and 70" independently one from the other.

In other words, therefore, the adjustment unit 50 makes the machine equipped with the folding or interfolding unit as described with reference to the FIGS. 13A to 20 highly flexible.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A folding or interfolding unit of a plurality of sheets of paper, comprising:

a first and a second folding or interfolding roll configured to fold or interfold said plurality of sheets of paper according to a predetermined folding or interfolding configuration, at a folding or interfolding zone, each said first and second folding or interfolding rolls comprising:

a tubular body configured to rotate in a predetermined direction of rotation about a longitudinal rotation axis oriented along a horizontal direction;

a plurality of gripping groups integral in rotation with said tubular body, each gripping group of said plurality comprising:

a mechanical gripping member configured to move, at a gripping point having a first angular position, from a releasing configuration to a gripping configuration, where is arranged to mechanically hold said or each, sheet of said plurality of sheets up to a releasing point having a second angular position;

at least one suction hole associated to each mechanical gripping member and configured to cause said or each sheet of paper to be sucked to introduce the same into the mechanical gripping member;

a vacuum distribution device configured to selectively pneumatically connect at least one suction hole at a time to a device for generating a determined vacuum degree in such a way to cause said or each sheet to be sucked between a position of starting suction and a position of ending suction;

each said first and second folding or interfolding rolls furthermore comprises:

an actuation group configured to cause a mechanical gripping member at a time of said plurality to move from said releasing configuration to said gripping configuration at said gripping point and from said gripping configuration to said releasing configuration at said releasing point;

an adjustment group configured to move said actuation group with respect to said respective folding, or interfolding roll, to selectively move the same in a predetermined spatial position to which correspond a first and a second angular position of said gripping point and of said releasing point respectively;

wherein each actuation group provides a guide member configured to guide each mechanical gripping member at a time along a predetermined trajectory during rotation of said folding or interfolding roll about said longitudinal axis, said guide member comprising at least one closing stretch arranged to cause each mechanical gripping member to move from said releasing configuration to said gripping configuration, and at least one opening stretch arranged to cause each mechanical gripping member to move from said gripping configuration to said releasing configuration;

and wherein each adjustment group is configured to rotate said guide member with respect to the respective folding, or interfolding roll about said respective longitudinal axis to position said guide member in a predetermined spatial position in such a way to set the angular position of said gripping point and of said releasing point.

2. The folding or interfolding unit according to claim 1, wherein each guide member comprises a first portion provided with said closing stretch, and at least a second portion provided with said opening stretch, and wherein at least one between said first and second portions of said guide member is configured to move with respect to said respective folding, or interfolding roll to position in a predetermined spatial position.

3. The folding or interfolding unit according to claim 2, wherein said adjustment group comprises a first displacement device configured to rotate said first portion of said guide member with respect to said respective folding, or interfolding roll, and a second displacement device configured to rotate said second portion of said guide member with respect to said respective folding, or interfolding roll, in such a way to adjust the position of said gripping point and of said releasing point independently from each other.

4. The folding or interfolding unit according to claim 3, wherein each said mechanical gripping member comprises a movable portion arranged to move from/towards a fixed portion to move from said gripping configuration to said releasing configuration and vice versa, and wherein each said actuation group comprises:

a plurality of support shafts rotatably connected to a tubular body of said first, or second, folding or interfolding roll, each support shaft of said plurality being engaged at a first engagement portion to a respective actuation arm and being arranged to support a movable portion of a respective mechanical gripping member;

a plurality of feeler members arranged to engage a respective actuation arm at a second engagement portion, each feeler member of said plurality being arranged to move, during rotation of a respective folding, or interfolding roll between said first and second folding or interfolding rolls along said guide member defining said predetermined trajectory and configured to cause a respective support shaft to rotate at a first and a second angular position to cause said movable portion of said gripping member to change inclination with respect to said fixed portion at said predetermined angular positions in such a way to cause said releasing configuration to move from said releasing configuration to said gripping configuration, or vice versa.

5. The folding or interfolding unit according to claim 4, wherein a plurality of elastic return members is furthermore provided, each of which associated to a respective mechanical gripping member and configured to elastically oppose said movement of a movable portion of a respective gripping member from said gripping configuration to said releasing configuration.

6. The folding or interfolding unit according to claim 4, wherein each said actuation group provides a desmodromic cam and wherein-said guide member comprises at least one closing stretch configured to cause said movable portion to change inclination with respect to said fixed portion of said gripping member to move in said gripping configuration at said first angular position, and at least one opening stretch arranged to cause said movable portion to change inclination with respect to said fixed portion of said gripping member to move the same in said releasing configuration at said second angular position.

7. The folding or interfolding unit according to claim 6, wherein said shaped guide member comprises:

a first sliding track provided with said closing stretch and arranged to guide a first feeler member of an actuation arm; and a second sliding track comprising said opening stretch and arranged to guide a second feeler member of said actuation arm;

and wherein said adjustment group is configured to adjust the spatial position of at least one between said first and second sliding tracks with respect to the respective folding, or interfolding roll.

8. The folding or interfolding unit according to claim 7, wherein said adjustment group comprises at least one displacement device associated to said first sliding track, or to said second sliding track.

9. The folding or interfolding unit according to claim 8, wherein the first displacement device is configured to adjust the spatial position of said first sliding track and wherein the second displacement device is configured to adjust the spatial position of said second sliding track.

10. The folding or interfolding unit according to claim 1, further comprising:

a first and a second plurality of removing fingers configured to cause said plurality of sheets of paper to be removed from an external surface of a respective folding, or interfolding roll;

a separation group comprising a first and a second plurality of separation members configured to enter from opposite sides into a completed stack of folded or interfolded sheets, and to separate the same from a following stack of folded or interfolded sheets.

11. The folding or interfolding unit according to claim 1, wherein a central control unit is, furthermore, provided configured to operate said adjustment group as a function of at least one parameter selected from the group comprising: advancing speed of said plurality of sheets of paper, length of the worked sheet of paper weight of the worked sheet of paper, type of folded or interfolded product to be produced.

12. The folding or interfolding unit according to claim 1, wherein each guide member comprises a first portion provided with said closing stretch, and at least a second portion provided with said opening stretch, and wherein at least one between said first and second portions of said guide member is configured to move with respect to said respective folding, or interfolding roll to position in a predetermined spatial position.

13. A folding or interfolding unit of a plurality of sheets of paper, comprising:

a first and a second folding or interfolding roll configured to fold or interfold said plurality of sheets of paper according to a predetermined folding or interfolding configuration, at a folding or interfolding zone, each said first and second folding or interfolding rolls comprising:

a tubular body configured to rotate in un a predetermined direction of rotation about a longitudinal rotation axis oriented along a horizontal direction;

a plurality of gripping groups integral in rotation with said tubular body, each gripping group of said plurality comprising:

a mechanical gripping member configured to move, at a gripping point having a first angular position, from a releasing configuration to a gripping configuration, where is arranged to mechanically hold said or each, sheet of said plurality of sheets up to a releasing point having a second angular position;

at least one suction hole associated to each mechanical gripping member and configured to cause said or each sheet of paper to be sucked to introduce the same into the mechanical gripping member;

a vacuum distribution device configured to selectively pneumatically connect at least one suction hole at a time to a device for generating a determined vacuum degree in such a way to cause said or each sheet to be sucked between a position of starting suction and a position of ending suction;

each said first and second folding or interfolding rolls furthermore comprises:

an actuation group configured to cause a mechanical gripping member at a time of said plurality to move from said releasing configuration to said gripping configuration at said gripping point and from said gripping configuration to said releasing configuration at said releasing point;

an adjustment group configured to move said actuation group with respect to said respective folding, or interfolding roll, to selectively move the same in a predetermined spatial position to which correspond a first and a second angular position of said gripping point and of said releasing point respectively;

and wherein each said folding or interfolding roll, comprises:

a fixed tubular body positioned coaxially to said tubular body, said fixed tubular body being provided with an external lateral surface and an internal lateral surface communicating with each other by at least one aperture and a longitudinal cavity pneumatically connected to said device for generating a predetermined vacuum degree;

and wherein said vacuum distribution device comprises:

a suction chamber pneumatically communicating to said longitudinal cavity and delimited by an internal lateral surface of said tubular body and laterally by a first and a second sealing element arranged to extend longitudinally to said tubular body, said suction chamber being configured to selectively pneumatically connect said longitudinal cavity to a suction hole at a time between said first and second predetermined angular positions.

14. A method for folding or interfolding a plurality of sheets of paper, comprising the steps of:

folding or interfolding by a first and a second folding or interfolding roll said plurality of sheets of paper according to a predetermined folding or interfolding configuration, at a folding or interfolding zone, each said first and second folding or interfolding rolls comprising:

a tubular body configured to rotate in a predetermined direction of rotation about a longitudinal rotation axis oriented along a horizontal direction;

a plurality of gripping groups integral in rotation with said tubular body, each gripping group of said plurality comprising:

a mechanical gripping member configured to move, at a gripping point having a first angular position, from a releasing configuration to a gripping configuration, where is arranged to mechanically hold said or each, sheet of said plurality of sheets up to a releasing point having a second angular position;

at least one suction hole associated to each mechanical gripping member and configured to cause said or each sheet of paper to be sucked to introduce the same into said mechanical gripping member;

a vacuum distribution device configured to selectively pneumatically connect at least one suction hole at a time to a device for generating a determined vacuum degree in such a way to cause said or each sheet to be sucked between a position of starting suction and a position of ending suction;

causing by an actuation group a mechanical gripping member at a time of said plurality to move from said releasing configuration to said gripping configuration at said gripping point and from said gripping configuration to said releasing configuration at said releasing point;

moving by an adjustment group said actuation group with respect to said respective folding, or interfolding roll, to selectively position the same in a predetermined spatial position to which correspond a first and a second angular position of said gripping point and of said releasing point respectively;

wherein each actuation group provides a guide member configured to guide each mechanical gripping member at a time along a predetermined trajectory during rotation of said folding or interfolding roll about said longitudinal axis, said guide member comprising at least one closing stretch arranged to cause each mechanical gripping member to move from said releasing configuration to said gripping configuration, and at least one opening stretch arranged to cause each mechanical gripping member to move from said gripping configuration to said releasing configuration;

and wherein each adjustment group is configured to rotate said guide member with respect to the respective folding, or interfolding roll about said respective longitudinal axis to position said guide member in a predetermined spatial position in such a way to set the angular position of said gripping point and of said releasing point.

* * * * *